US010476181B2

(12) United States Patent
Kaneko et al.

(10) Patent No.: US 10,476,181 B2
(45) Date of Patent: Nov. 12, 2019

(54) QUICK CONNECT TERMINAL CONNECTOR

(71) Applicant: Molex, LLC, Lisle, IL (US)

(72) Inventors: Tomonari Kaneko, Ebina (JP); Shigeru Akiyama, Machida (JP); Toshiya Oda, Yokohama (JP); Hiroki Kobayashi, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/864,406

(22) Filed: Jan. 8, 2018

(65) Prior Publication Data

US 2018/0219306 A1 Aug. 2, 2018

Related U.S. Application Data

(60) Provisional application No. 62/451,950, filed on Jan. 30, 2017.

(30) Foreign Application Priority Data

Sep. 21, 2017 (JP) ..... 2017-181361

(51) Int. Cl.
*H01R 4/48* (2006.01)
*H01R 12/57* (2011.01)
*H01R 12/51* (2011.01)

(52) U.S. Cl.
CPC ..... *H01R 4/4836* (2013.01); *H01R 4/4818* (2013.01); *H01R 4/4827* (2013.01); *H01R 12/515* (2013.01); *H01R 12/57* (2013.01)

(58) Field of Classification Search
CPC .... H01R 4/4836; H01R 12/57; H01R 4/4818; H01R 4/4827; H01R 4/4845
USPC ..... 439/78, 81, 441, 834
See application file for complete search history.

(56) References Cited

U.S. PATENT DOCUMENTS 3,099,505 A * 7/1963 Schwartz ..... H01R 4/4818 439/439
5,320,558 A * 6/1994 von Roretz ..... H01R 4/4827 439/441
5,703,757 A * 12/1997 Hayes ..... B60R 16/0238 174/549
6,048,095 A 4/2000 Shindo et al.
(Continued)

FOREIGN PATENT DOCUMENTS

CN 204349083 U 5/2015
JP H07-122307 A 5/1995
(Continued)

*Primary Examiner* — Travis S Chambers
(74) *Attorney, Agent, or Firm* — Molex, LLC

(57) ABSTRACT

A quick connect terminal connector is provided which includes first and second terminals and a casing. The first terminal and the second terminal are mutually and electrically separated. The casing covers at least part of the first terminal and the second terminal. The first terminal and the second terminal respectively include an attachment part, a resilient connection part and a contact part. The attachment part is attached to the casing. The resilient connection part extends in the insertion direction of the wire from the attachment part. The contact part is located at the tip of the resilient connection part capable of contacting a conductive wire of a wire inserted between the first terminal and the second terminal.

44 Claims, 20 Drawing Sheets

(56) References Cited

U.S. PATENT DOCUMENTS

| | | | | |
|---|---|---|---|---|
| 7,833,038 | B1 * | 11/2010 | King, Jr. | H01R 4/4818 439/276 |
| 8,328,586 | B2 | 12/2012 | Bies et al. | |
| 8,550,838 | B2 * | 10/2013 | Osagle | H01R 4/4818 439/441 |
| 8,591,271 | B2 | 11/2013 | Bies | |
| 9,444,155 | B2 * | 9/2016 | Chen | H01R 4/48 |
| 9,484,639 | B1 * | 11/2016 | Chen | H01R 4/4845 |
| 9,543,682 | B2 * | 1/2017 | Jin | H01R 4/4836 |
| 9,799,968 | B2 * | 10/2017 | Lin | H01R 4/48 |
| 2001/0010981 | A1 * | 8/2001 | Cutler | H01R 4/4827 439/441 |
| 2008/0248698 | A1 * | 10/2008 | Pizzi | H01R 13/68 439/709 |
| 2011/0030210 | A1 * | 2/2011 | King, Jr. | H01R 4/4818 29/857 |

FOREIGN PATENT DOCUMENTS

| | | | |
|---|---|---|---|
| JP | H09-232015 | A | 9/1997 |
| JP | 2002-110291 | A | 4/2002 |
| TW | 200836432 | A | 9/2008 |
| WO | 2005/013424 | A1 | 2/2005 |

* cited by examiner

QUICK CONNECT TERMINAL CONNECTOR

RELATED APPLICATIONS

This application claims priority to U.S. Provisional Application No. 62/451,950, filed Jan. 30, 2017 and Japanese Application No. 2017-181361, filed Sep. 21, 2017, both of which are incorporated herein by reference in their entireties.

TECHNICAL FIELD

The present disclosure relates to a quick connect terminal connector.

BACKGROUND ART

The present disclosure relates to a quick connect terminal connector configured such that by means of an operation of simply inserting (pushing in) a wire into a terminal, when the wire is clamped by the terminal, an electrical connection is simultaneously established, and more specifically relates to a quick connect terminal connector that enables the electrical detection of the connection of the wire to the terminal.

Conventional electronic devices include a connector with a terminal to which a wire is connected, that is soldered onto the surface of a printed circuit board and is configured so as to be surrounded by an insulating casing. Such a connector includes a so called quick connect terminal connector that establishes an electrical connection between the wire and the terminal at the same time the wire is clamped into the terminal by means of an operation of simply inserting the wire into the terminal (for example, see Patent Document 1).

Such a quick connect terminal connector is not only advantageous in terms of the process of inserting a wire into a terminal but also in terms of the simple process of pulling the wire out from the terminal to separate them. Specifically, the wire in a clamped state may easily be separated from the terminal simply by pressing a pressure arm that is formed on the insulating casing by fingertip or using a screw driver, or the like.

While the aforementioned quick connect terminal connector does have such advantages, because the terminal is covered by a housing, it is impossible to visually confirm that the wire has been inserted therein. Therefore, an operation involving pulling the wire is required in order to confirm that the wire has been securely inserted; however, excessively pulling the wire may result in defects such as causing the wire to come off or causing damage to the terminal.

Furthermore, even if a hole, etc. is preliminarily provided in the housing such that insertion of the wire can be visually confirmed, due to the downsizing of connectors, small holes or terminals may potentially lead to visual confirmation mistakes.

Therefore, in order to solve such shortcomings, a connector which electrically enables the detection of the insertion of a wire into the connector without fail, thereby ensuring establishment of the electrical connection, has been proposed (for example, see Patent Document 2).

FIG. 20 is a cross-section view of a conventional connector.

In the drawing, 811 is a housing of a connector, and 851 is a terminal arranged in an internal space 820 of the housing 811. Furthermore, 891 is a switch installed in the housing 811, with the movable part thereof capable of being projected downward from a ceiling 822 of the internal space 820. The switch 891 is configured so as to be switched on when the movable part is in a downwardly projected state from the ceiling 822 and switched off when the movable part is in a state of having been pushed into the ceiling 822. A conductive spring member 861 having a wedge piece 862 and a tilting piece 863 is attached to a terminal 851, with the movable part of the switch 891 initially in a state of having been pushed into the ceiling 822 by the tilting piece 863.

Herein, when an electric wire 951 is inserted into the internal space 820 through a clear hole 821 formed on the front face of the housing 811, the wedge piece 862 and the tilting piece 863 of the spring member 861 are pressed onto the lower face of the electric wire 951 and come into contact with the electric wire 951 by a spring force. Thereby, the electric wire 951 becomes electrically conductive with the terminal 851 via the spring member 861. Furthermore, because the tilting piece 863 is pressed down by the electric wire 951, the movable part of the switch 891 enters a downwardly projecting state as illustrated. Thereby, the switch 891 is switched on, electrically detecting the establishment of a conductive connection between the electric wire 951 and the terminal 851.

Patent Document 1: U.S. Pat. No. 8,328,586 Specification

Patent Document 2: Japanese Unexamined Patent Application Publication No. H9-232015

SUMMARY

However, in the aforementioned conventional connectors, the structure is made complex due to the difficulty in downsizing, resulting in an increase in the manufacturing cost.

Herein, an object of the present disclosure is to resolve the conventional problematic aspects by providing a small sized, highly reliable quick connect terminal connector with a simple structure, while enabling detection of the contact between a wire and a terminal without fail at a low manufacturing cost.

Therefore, a quick connect terminal connector capable of connecting with a wire includes a first terminal and a second terminal electrically separated from each other, along with an integrally formed casing covering at least part of the first terminal and the second terminal, wherein, the first terminal and the second terminal respectively include an attachment part attached to the casing, a resilient connection part extending in the insertion direction of the wire from the attachment part, and a contact part located at the tip of the resilient connection part capable of contacting a conductive wire of a wire inserted between the first terminal and the second terminal.

With another aspect of the quick connect terminal connector, the attachment part further includes a securing part that is locked onto the casing so as to be secured.

Furthermore, with yet another aspect of the quick connect terminal connector, the first terminal and the second terminal are located closer to the front in the insertion direction of the wire from the contact part, respectively including a front securing part that is locked onto the casing so as to be secured.

Furthermore, with yet another aspect of the quick connect terminal connector, the contact part of the first terminal and the contact part of the second terminal are mutually separated in the initial state when the wire has not yet been inserted.

Furthermore, with additionally yet another aspect of the quick connect terminal connector, the contact part of the first terminal and the contact part of the second terminal are separated by an interval smaller than the diameter of a conductive wire of the wire in the direction perpendicularly crossing with respect to the insertion direction of the wire.

Furthermore, with additionally yet another aspect of the quick connect terminal connector, the contact part of the first terminal and the contact part of the second terminal are located at different locations with regard to the insertion direction of the wire.

Furthermore, with additionally yet another aspect of the quick connect terminal connector, the first terminal and the second terminal are in a linearly symmetrical form having a virtual straight line extending in the insertion direction of the wire as a symmetric axis and are arranged on both the right and left sides of the virtual straight line.

Furthermore, with additionally yet another aspect of the quick connect terminal connector, once the wire is inserted, the contact part of the first terminal and the contact part of the second terminal come into contact by clamping a conductive wire of the wire from both sides, making the first terminal and the second terminal mutually conductive to each other.

Furthermore, with additionally yet another aspect of the quick connect terminal connector, the first terminal and the second terminal respectively include a connection part that is connected to the connection pattern of a substrate, wherein the connection pattern is connected to a detection circuit for detecting the establishment of conductivity between the first terminal and the second terminal.

According to the present disclosure, the quick connect terminal connector is of a small size having a simple structure, but enables the assured detection of contact between a wire and a terminal, while enhancing the reliability and reducing the manufacturing cost.

DETAILED DESCRIPTION OF THE PREFERRED EMBODIMENTS

Embodiments will be described in detail below with reference to the drawings.

Figure 1:
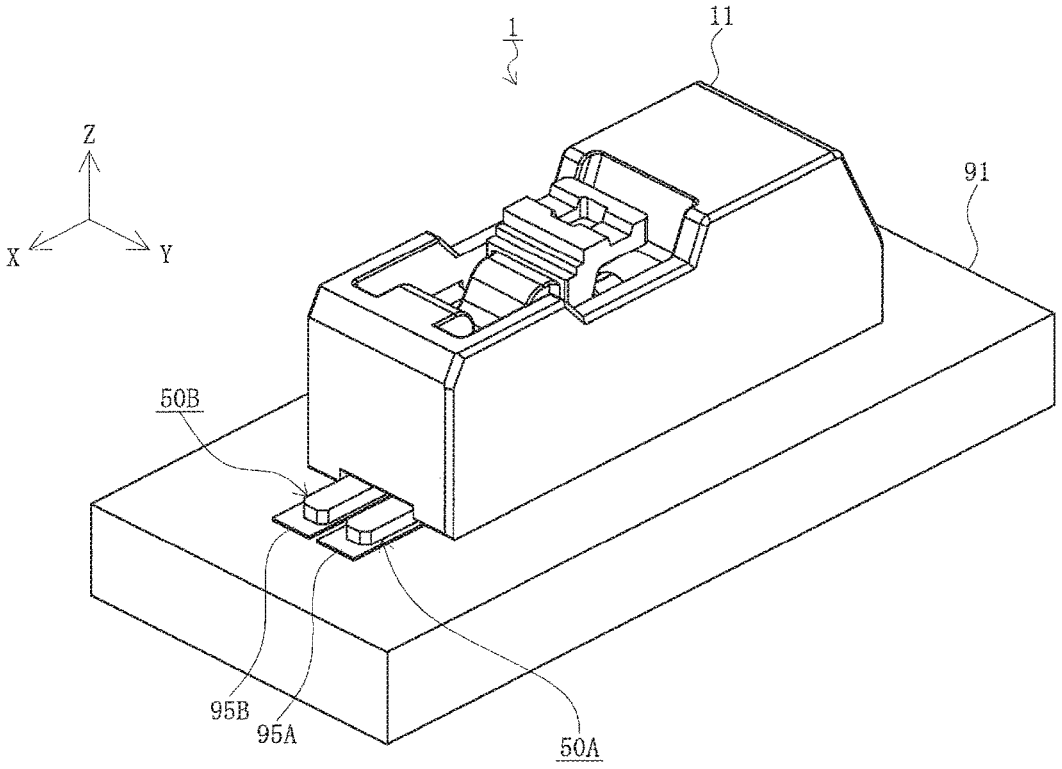
FIG. 1 is a perspective view of a connector in accordance with a first embodiment.
Figure 2:
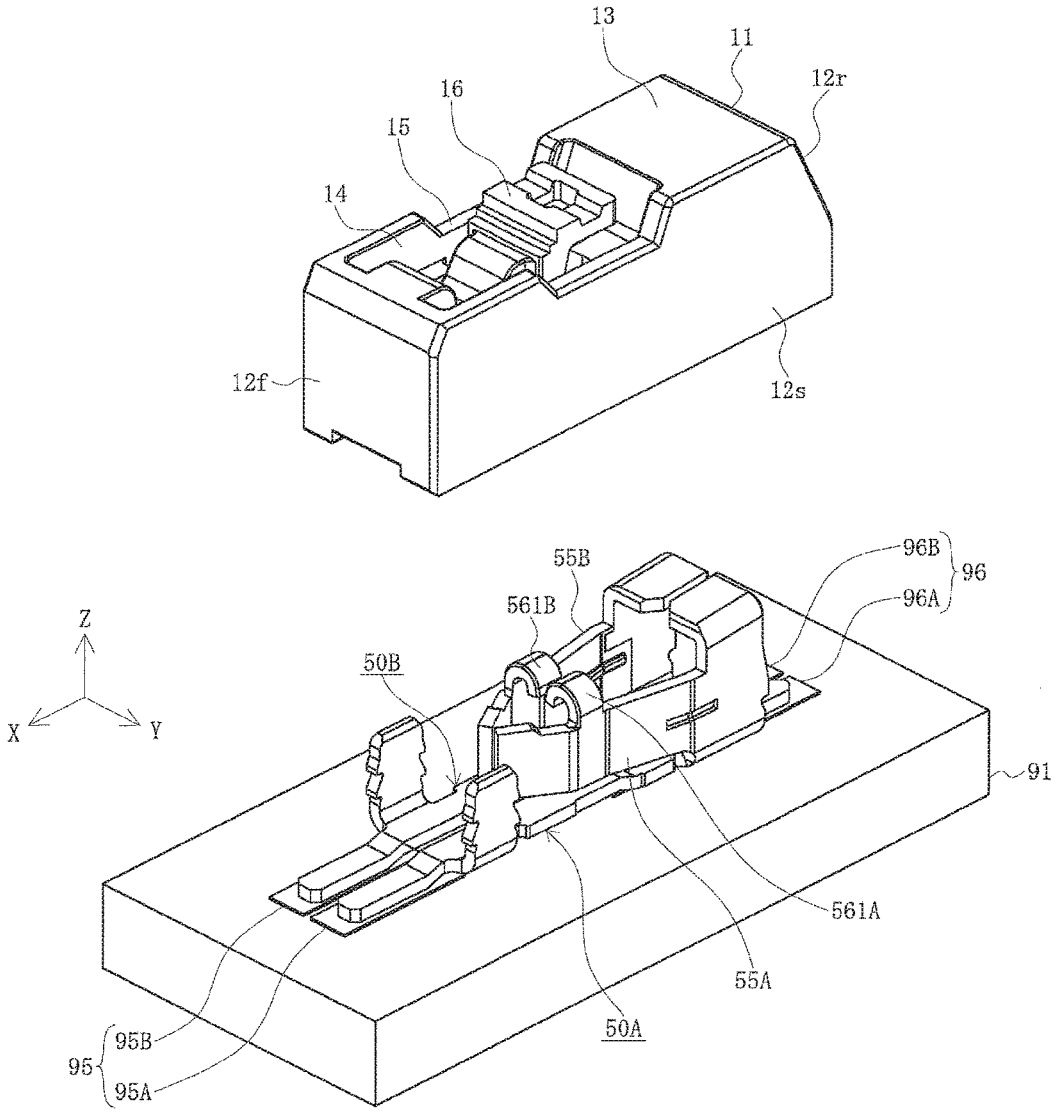
FIG. 2 is an exploded view of the connector in accordance with the first embodiment.
Figure 3:
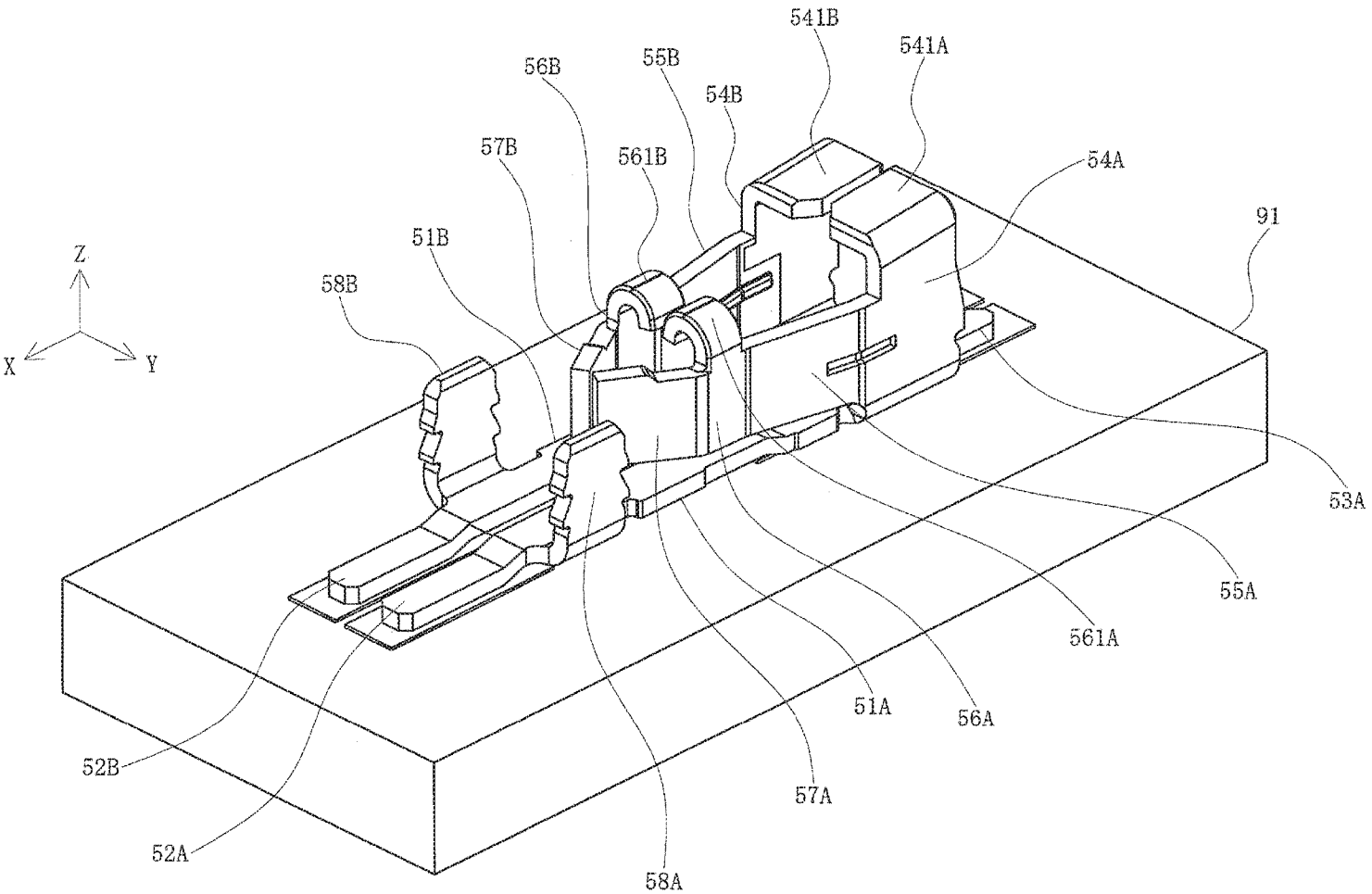
FIG. 3 is a perspective view of a terminal in accordance with the first embodiment.
Figure 4:
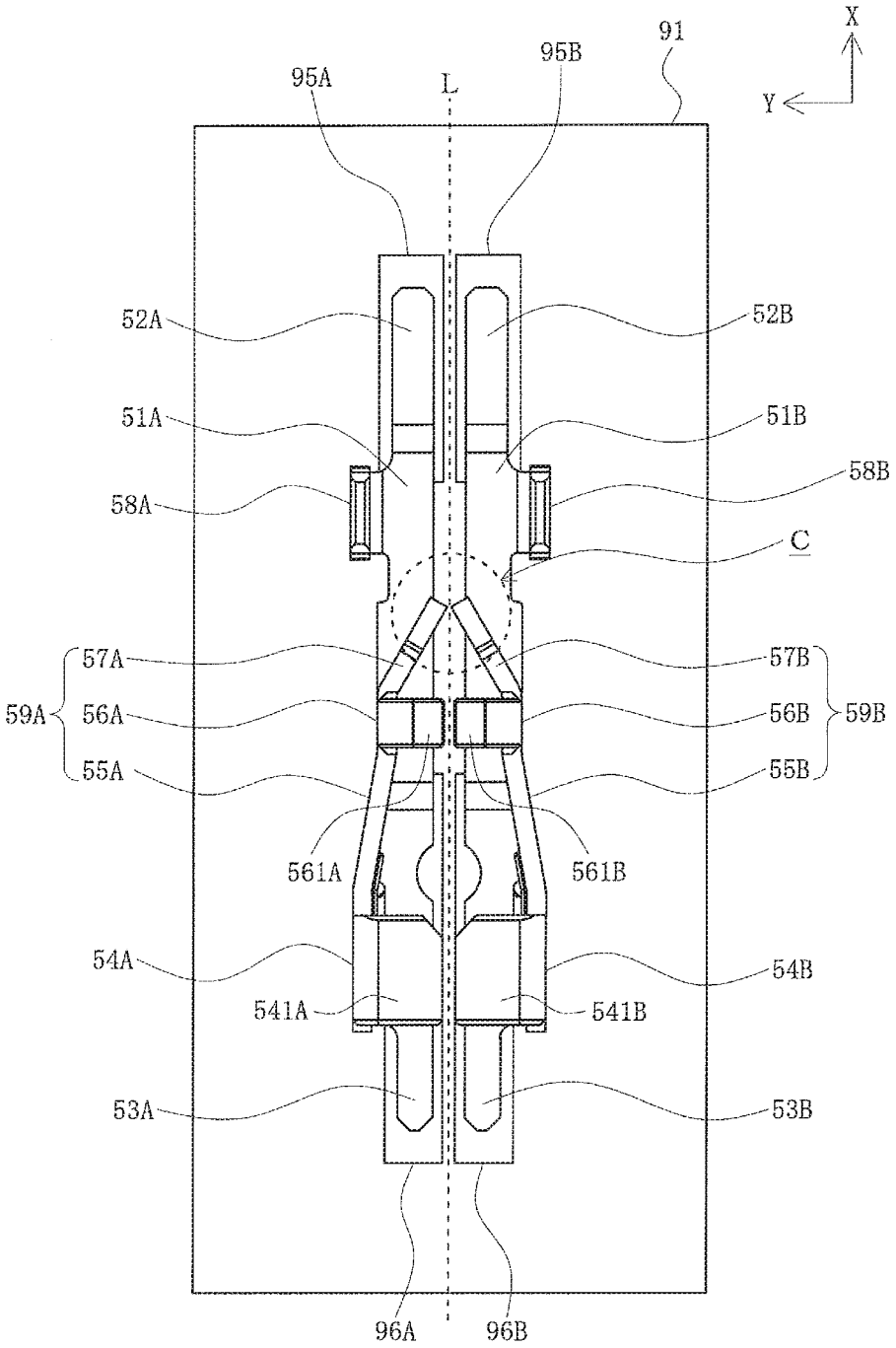
FIG. 4 is a top view of a terminal in accordance with the first embodiment.
Figure 5:
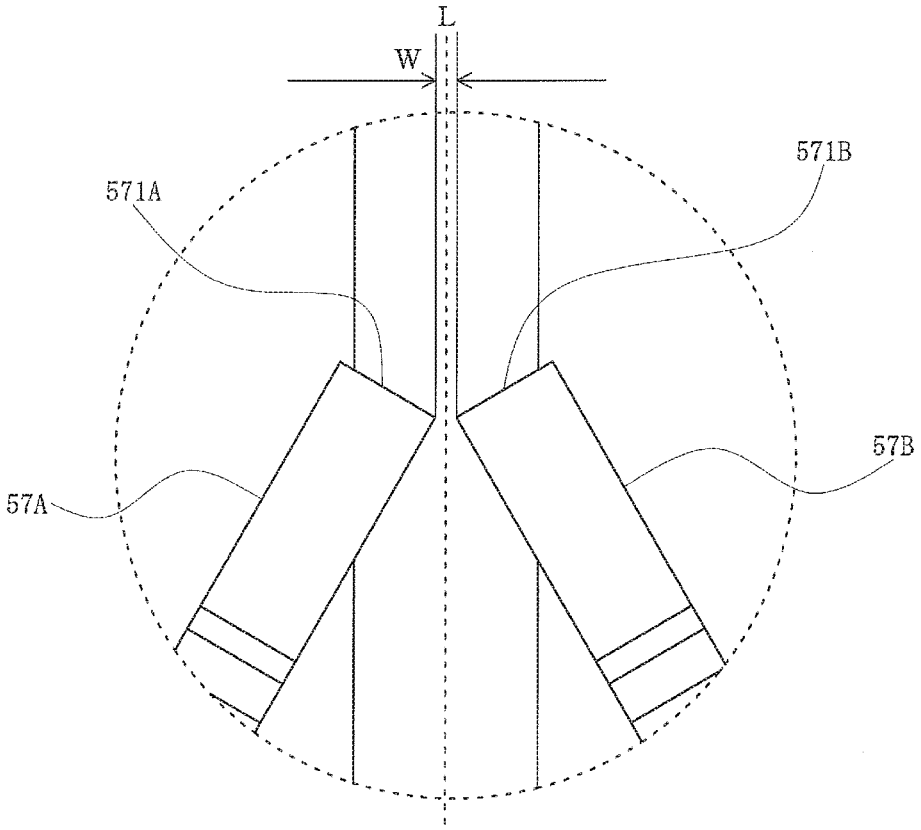
FIG. 5 is an enlarged view of part C of FIG. 4, showing an enlarged view of the main part of the terminal in accordance with the first embodiment.
Figure 6:
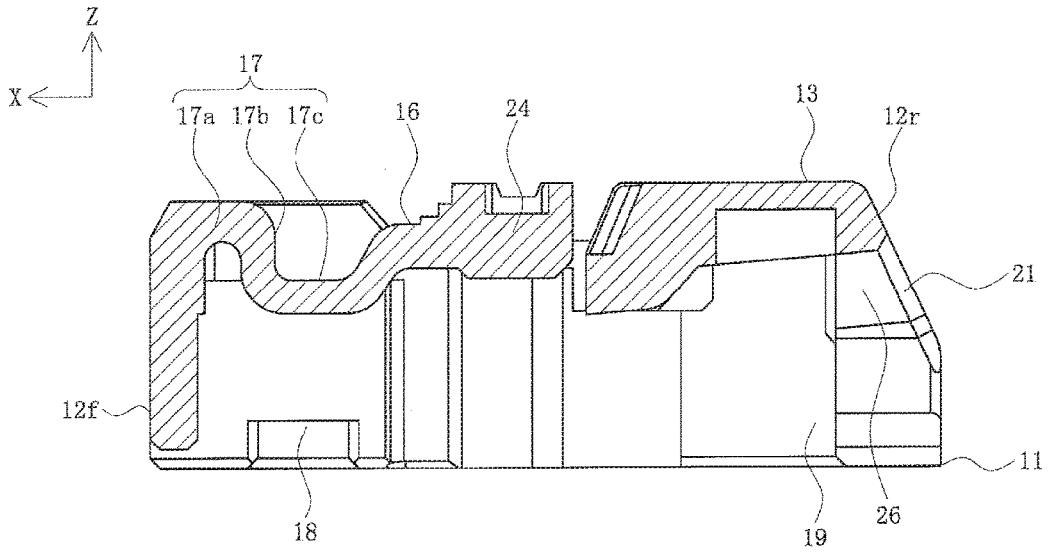
FIG. 6 is a longitudinal cross-sectional view of a housing in accordance with the first embodiment.
Figure 7:
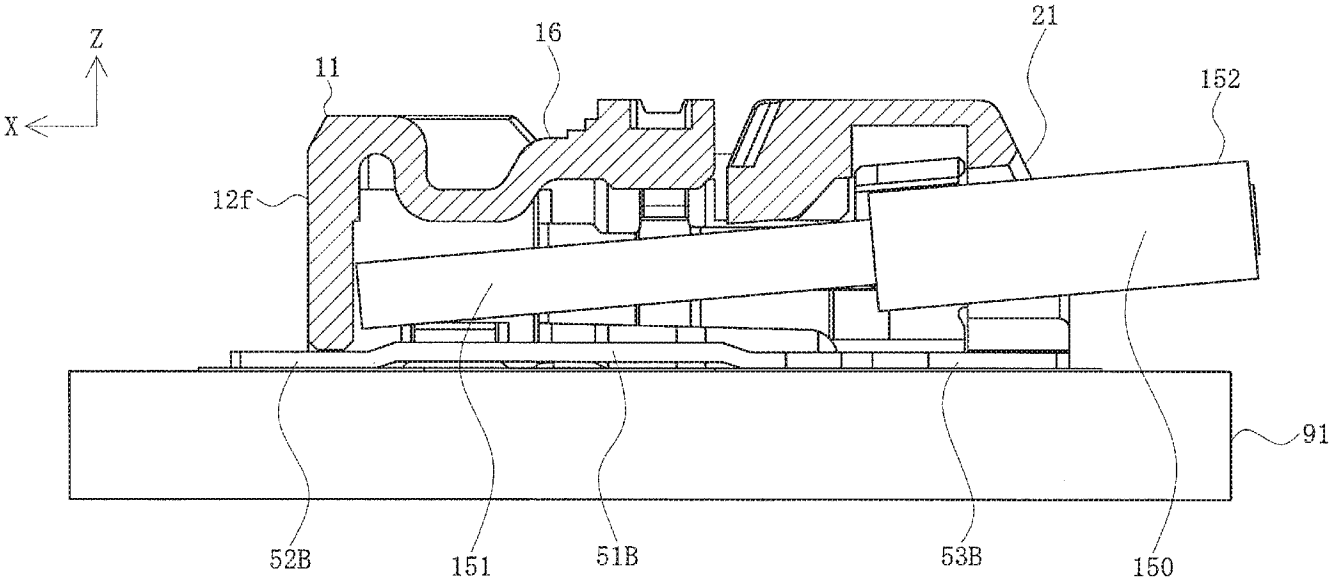
FIG. 7 is a longitudinal cross-sectional view of a connector into which a wire has been inserted in accordance with the first embodiment.
Figure 8:
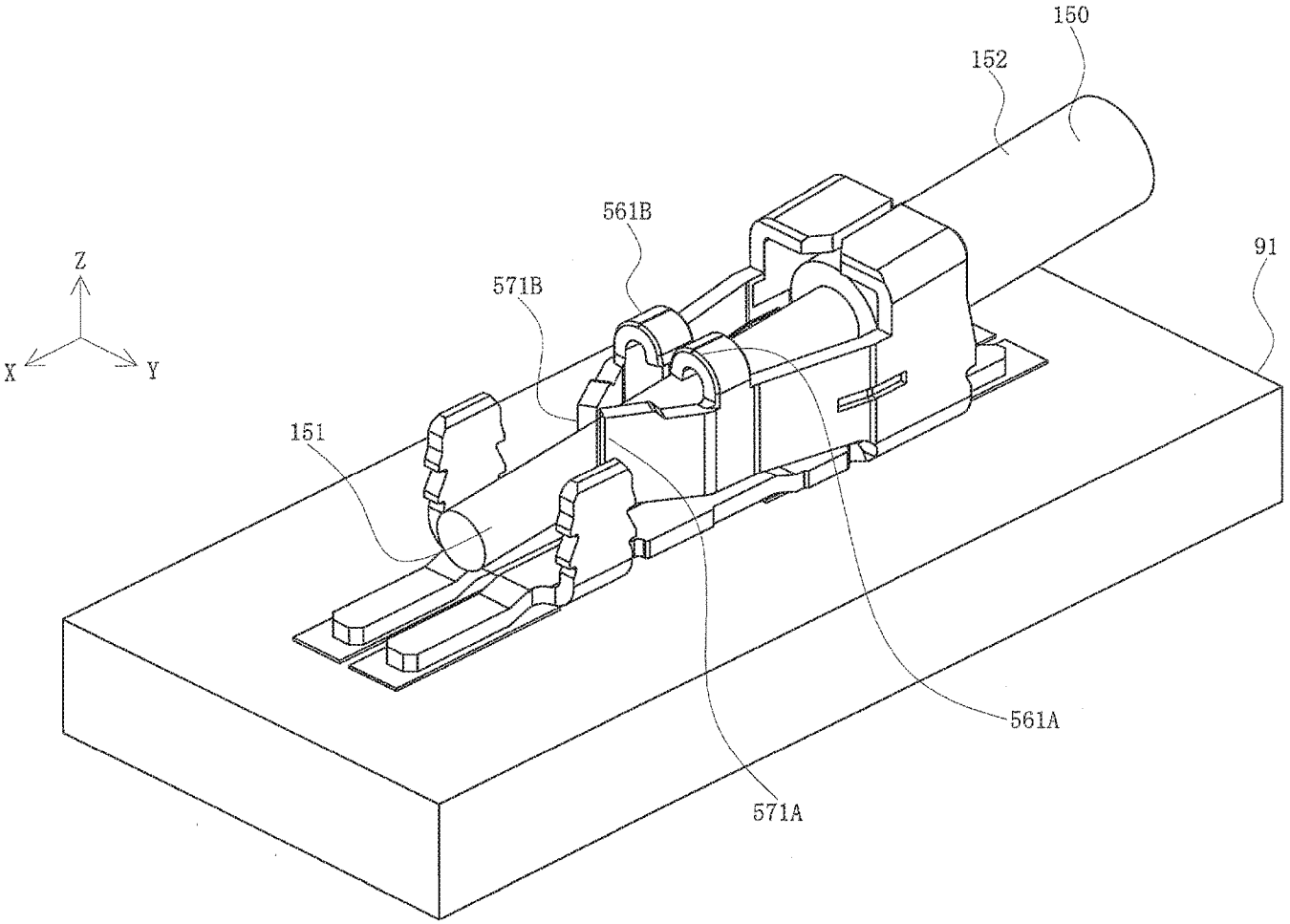
FIG. 8 is a perspective view of a terminal into which a wire has been inserted in accordance with the first embodiment.

FIG. 1 is a perspective view of a connector in accordance with the first embodiment, FIG. 2 is a perspective view of the connector in accordance with the first embodiment, FIG. 3 is a perspective view of a terminal in accordance with the first embodiment, FIG. 4 is a top view of the terminal in accordance with the first embodiment, FIG. 5 is an enlarged view of part C of FIG. 4, and is an enlarged view of the terminal in accordance with the first embodiment, FIG. 6 is a longitudinal cross-sectional view of a housing in accordance with the first embodiment, FIG. 7 is a longitudinal cross-sectional view of a connector into which a wire has been inserted in accordance with the first embodiment, and FIG. 8 is a perspective view of a terminal into which a wire has been inserted in accordance with the first embodiment.

The present embodiment is an example of the principle of the present disclosure, and specific embodiments are illustrated in the drawings and are described in detail in the specification with the understanding there is no intention of limiting the configuration described herein as an example.

The present disclosure is not limited to the present embodiments described below, and various modifications based on the gist of the present disclosure are possible and are not excluded from the scope of patent claims based on the present disclosure.

Expressions indicating directions such as upper, lower, left, right, front, rear, etc. in the present embodiment are used to describe the structure as well as the movement of various elements stated as examples and are relative expressions rather than absolute. These expressions are appropriate when each element is in a location illustrated in the drawings, but are expected to be changed accordingly when the description of the location of the element changes.

In the figures, 1 is a connector that is the quick connect terminal connector of the present embodiment mounted on the surface of a substrate 91, into which a wire 150 is to be inserted. It should be noted that, as illustrated in FIG. 7, the wire 150 is a wire coated by an insulation coat 152 around a conductive wire 151 which is a core wire, with the conductive wire 151 supposedly exposed at a portion ranging from the tip to a predetermined length with the insulation coat 152 removed. The connector 1 may be used for all kinds of devices or apparatuses, etc., such as industrial electric and electronic devices, electric and electronic devices for domestic use, computers, communication devices, etc.; however, herein, for convenience of explanation, it is presumed that the connector 1 is one to be mounted on the surface of the substrate 91, for example, such as a printed circuit board used for electronic devices, etc., a flexible flat cable (FFC), a flexible circuit board (FPC), or the like.

It should be noted that occasionally the insertion direction (positive direction of the X-axis) of the wire 150 is described as the front, while the pulling direction (negative direction of the X-axis) is described as the rear.

As illustrated in the drawings, the connector 1 is provided with a first terminal 50A and a second terminal 50B, which are a pair of terminals molded by the pressing of a plate material composed of a conductive material such as metal, and a casing 11 composed of an insulating material such as synthetic resin, etc. and integrally molded substantially covering the entire surroundings of the first terminal 50A and the second terminal 50B. Moreover, the first terminal 50A and the second terminal 50B are electrically and physically connected by a connecting means such as soldering, etc., to a first front connection pattern 95A, a second front connection pattern 95B, a first rear connection pattern 96A, and a second rear connection pattern 96B which are connection patterns formed on the surface of the substrate 91.

As illustrated in FIG. 4, it should be noted that the first front connection pattern 95A and the second front connection pattern 95B as well as the first rear connection pattern 96A and the second rear connection pattern 96B are arranged on both the right and left sides of a virtual straight line L so as to be linearly symmetrical with the virtual straight line L extending in the insertion direction of the wire 150 as its symmetric axis. Likewise, the first terminal 50A and the second terminal 50B also have a shape that is linearly symmetric, having the virtual straight line L as a symmetric axis, and are arranged on both the right and left sides of the virtual straight line L.

Further, the first front connection pattern 95A and the second front connection pattern 95B are formed away from each other, the first rear connection pattern 96A and the second rear connection pattern 96B are formed away from each other, and the first terminal 50A and the second terminal 50B are mutually separated in the initial state prior to the insertion of the wire 150.

It should be noted that when the first front connection pattern 95A and the second front connection pattern 95B are described as a whole, when the first rear connection pattern 96A and the second rear connection pattern 96B are described as a whole, when the first terminal 50A and the second terminal 50B are described as a whole, and when each part of the first terminal 50A and each part of the second terminal 50B are described as a whole, the words "first" and "second," along with the symbols "A" and "B" are omitted in the descriptions.

The terminal 50 is provided with a base part 51 in a long and narrow plate form extending in the front/rear direction (X-axis direction) parallel to the surface of the substrate 91, a front connection part 52 in a long and narrow plate form extending to the front from the front end of the base part 51, and a rear connection part 53 in a long and narrow plate form extending in the rear direction from the rear end of the base part 51. The front connection part 52 and the rear connection part 53 are respectively connected to a front connection pattern 95 and a rear connection pattern 96 formed on the surface of the substrate 91 by a connecting means such as soldering, or the like. It should be noted that the base part 51 is preferably located slightly higher (in the positive direction of the Z-axis) from the front connection part 52 and the rear connection part 53 away from the surface of the substrate 91.

Moreover, the terminal 50 includes a front engaging part 58 as a front securing part vertically extending upward from the outer rim of the base part 51 in the front end proximity of the base part 51, a vertically elongated section 54 as an attachment part vertically extending upward from the outer rim of the base part 51 in the rear end proximity of the base part 51, and a resilient connection part 59 in a leaf spring form extending from the front end of the vertically elongated section 54 to the front (insertion direction of the wire 150). The resilient connection part 59 includes a front elongated section 55 extending from the front end of the vertically elongated section 54 toward the front, an intermediate elongated section 56 extending from the front end of the front elongated section 55 toward the front, and a contacting piece 57 extending from the front end of the intermediate elongated section 56 toward the front. The tip of the contacting piece 57, in other words, a contact part 571 of the tip of the resilient connection part 59 is a portion that can be contacted with the conductive wire 151 of the wire 150.

As illustrated in FIG. 4, in a plane view, a first front engaging part 58A and a second front engaging part 58B on the right and left are parallel to each other, a first vertically elongated section 54A and a second vertically elongated section 54B on the right and left are mutually parallel to each other, a first front elongated section 55A and a second front elongated section 55B on the right and left are inclining so as to be closer to each other toward the front, a first intermediate elongated section 56A and a second intermediate elongated section 56B on the right and left are parallel to each other, and a first contacting piece 57A and a second contacting piece 57B on the right and left are inclining so as to be closer to each other toward the front. As illustrated in FIG. 5, in the initial state when the wire 150 has not yet been inserted, a first contact part 571A which is the tip of the first contacting piece 57A and a second contact part 571B which is the tip of the second contacting piece 57B are close to each other, but are in a state facing each other leaving an interval W that is smaller than the diameter of the conductive wire 151.

Furthermore, the terminal 50 includes a horizontally elongated section 541 extending inward from the upper end of the vertically elongated section 54, along with a connection release part 561 extending inward in a curve from the upper end of the intermediate elongated section 56. When viewed from the front and the rear directions, the connection release part 561 is warped as if forming an upwardly projecting arc. As illustrated in FIG. 4, a first horizontally elongated section 541A and a second horizontally elongated section 541B on the right and left are in proximity but separated from each other; likewise, a first connection release part 561A and a second connection release part 561B on the right and left are in proximity but separated from each other.

The casing 11 has an open bottom face and is a box like member having a cavity therein. Moreover, the casing 11 has a pair of side face parts 12*s* defining the right and left of the cavity, a front face part 12*f* defining the front side, a rear face part 12*r* defining the rear side, and a top face part 13 defining the top thereof. At the top face part 13, a clamp release lever 16 is formed as a single unit, with a terminal exposure hole 14 formed in order to form a clamp release lever 16. Furthermore, a groove shaped lever stopper 15 is formed at least at part of a portion corresponding to the terminal exposure hole 14 at the upper end of the side face part 12*s* in order to prevent the free end of the clamp release lever 16 from excessively entering into the terminal exposure hole 14 when the free end (rear end) of the clamp release lever 16 is pressed down by the finger of an operator or a tool as a result of having been caught. Furthermore, an insertion hole 21 allowing the wire 150 to be inserted into the cavity inside the casing 11 is formed in the rear face part 12*r*.

As illustrated in FIG. 6, the clamp release lever 16 extends from the casing 11 and is provided with a flexible elongated part 17 that has a bending structure to enhance resilience. The flexible elongated part 17 includes a first elongated section 17*a* extending from a top face part 13 in the horizontal direction, a curved section 17*b* first bending downward in the vertical direction from the terminal end of the first elongated section 17*a*, subsequently extending in the horizontal direction, and finally bending upward in an inclining manner, and a second elongated section 17*c* extending in the horizontal direction from the terminal end of the curved section 17*b*. The clamp release lever 16 has the flexible elongated part 17 in such a configuration, thereby giving it high resilience. Moreover, a pressing part 24 is formed at the free end (terminal end) of the flexible elongated part 17. When the free end of the clamp release lever 16 is pressed down by the finger of an operator or a tool, the pressing part 24 enters between the first connection release part 561A and the second connection release part 561B on the right and left, widening the interval between the first connection release part 561A and the second connection release part 561B by pushing.

Furthermore, a through hole 26 is formed in the top face part 13 to insert the wire 150 that has been inserted from the insertion hole 21. The wire 150 inserted from the insertion hole 21 moves forward via the through hole 26 and into the casing 11.

As illustrated in FIG. 6, a terminal front recessed part 18, which is a hole part to lock the front engaging part 58 of the terminal 50, is formed in the side face part 12*s* of the casing 11. Moreover, on the inner side face of the side face part 12*s*, a terminal rear engaging part 19 that is a concave entry part to house and lock at least a part of the vertically elongated section 54 of the terminal 50 is formed. Further, as illustrated in FIG. 1, when the casing 11 covering nearly the entire circumference of the terminal 50 is in a mounted state, the front engaging part 58 enters the terminal front recessed part 18 so as to be locked, with at least part of the vertically elongated section 54 as an attachment part accommodated in the terminal rear engaging part 19 before being attached to the casing 11, thereby assuredly connecting the terminal 50 and the casing 11.

In the present embodiment, the first front connection pattern 95A and the second front connection pattern 95B, which are connection patterns formed on the surface of the substrate 91, are presumed to have been connected to a detection circuit not illustrated. Subsequently, when the wire 150 is inserted into the connector 1, causing the first contacting piece 57A and the second contacting piece 57B on the right and left to come into contact with the conductive wire 151, the first terminal 50A and the second terminal 50B become mutually conductive to each other. As a result, the detection circuit detects the establishment of conductivity between the first front connection pattern 95A and the second front connection pattern 95B, detecting that the wire 150 has been inserted into the connector 1 and the conductive wire 151 has come into contact with the terminal 50.

Next, the operation of inserting the wire 150 into the connector 1 in the aforementioned configuration to establish a connection will be described.

First, from the rear side of the connector 1 mounted on the surface of the substrate 91, an operator inserts the tip of the wire 150, at which the conductive wire 151 is exposed, into the insertion hole 21 that has been formed in the rear face part 12*r* of the casing 11. Subsequently, as the operator moves the wire 150 forward, the tip of the wire 150 moves through the through hole 26, thereby causing the wire 150 to enter the casing 11. Thereafter, the conductive wire 151 passes underneath the horizontally elongated section 541 and through a space between the vertically elongated sections 54 on the right and left, entering between the first resilient connection part 59A and the second resilient connection part 59B on the right and left.

Then, when the operator moves the wire 150 further forward, the tip of the wire 150 enters between the first contacting piece 57A and the second contacting piece 57B on the right and left, passes between the first contact part 571A and the second contact part 571B on the right and left while pushing to open the interval between the first contacting piece 57A and the second contacting piece 57B, and finally reaches the location illustrated in FIGS. 7 and 8. This completes the state of connection of the wire 150 to the connector 1.

While in this state, due to the spring force invoked by the front elongated section 55 and the contacting piece 57 resiliently deformed by the wire 150, the contacting piece 57, more specifically, the contact part 571 of the tip thereof is caused to be pressed onto the conductive wire 151 from both the right and left sides while clamping the conductive wire 151, assuredly maintaining the contact of the conductive wire 151 and the terminal 50. Furthermore, because the first terminal 50A and the second terminal 50B on the right and left are conductive to each other via the conductive wire 151, the detection circuit connected to the first front connection pattern 95A and the second front connection pattern 95B detects that the wire 150 has been inserted into the connector 1 and the conductive wire 151 has come into contact with the terminal 50.

Next, the operation of releasing the connection between the connector 1 and the wire 150 by pulling the wire 150 that has been inserted into the connector 1 will be described.

First, the operator presses down, with a finger or a tool, the free end of the clamp release lever 16 formed in the casing 11 of the connector 1 to which the wire 150 has been connected. Subsequently, the pressing part 24 enters between the first connection release part 561A and the second connection release part 561B on the right and left, thereby opening the interval between the first connection release part 561A and the second connection release part 561B by pushing. This opens the interval between contacting pieces 57 on the right and left sandwiching the conductive wire 151, more specifically, widening the interval of contact parts 571 at the tip thereof and releasing the clamped conductive wire 151.

In this state, when the operator pulls the wire 150 to the back, the wire 150 retreats smoothly, breaking away from the insertion hole 21 formed in the rear face part 12*r* of the casing 11. Thereafter, the free end of the clamp release lever 16 is released from being pressed by the operator. This causes the terminal 50 to return to the initial state which is the state in which the first terminal 50A and the second terminal 50B are separated without contacting each other; consequently, the detection circuit connected to the first front connection pattern 95A and the second front connection pattern 95B detects that the first front connection pattern 95A and the second front connection pattern 95B are no longer conductive, thereby detecting that the connector 1 and the wire 150 are disconnected.

It should be noted that the explanation herein was made with regard to an example in which the front connection pattern 95 and the rear connection pattern 96 are separated from each other and individually formed; however, the front connection pattern 95 and the rear connection pattern 96 may also be integrally formed.

Furthermore, the first terminal 50A and the second terminal 50B are manufactured, for example, by continuously press molding while the back end part of the first rear connection part 53A and the second rear connection part 53B are in a state of being connected to a runner. If the first terminal 50A and the second terminal 50B are in a linearly symmetric form having a line perpendicularly crossing the transporting direction of the runner, that is, the virtual straight line L illustrated in FIG. 4 as a symmetric axis, even when the first terminal 50A and the second terminal 50B are in a state of being separated by a gap, press molding is possible just like with a single terminal. For this reason, this is convenient for continuously manufacturing terminals.

However, the first terminal 50A and the second terminal 50B are not necessarily limited to being linearly symmetric and, for example, the first contacting piece 57A and the second contacting piece 57B may be individually formed by separating the front half part and the rear half part in the insertion direction of the wire 150.

Moreover, other formations such as attaching the first terminal 50A and the second terminal 50B to the casing 11 while in a separated state by extending the first resilient connection part 59A of the first terminal 50A from the first horizontally elongated section 541A but not from the first vertically elongated section 54A and by extending the second resilient connection part 59B of the second terminal 50B from the second base part 51B, may be considered. In this case, the first contact part 571A and the second contact part 571B are arranged horizontally with respect to the substrate.

As described, in the present embodiment, the connector 1 is a quick connect connector enabling a connection to the wire 150, and is provided with the first terminal 50A and the second terminal 50B which are electrically separated from each other, and the casing 11, which is integrally formed and covers at least a part of the first terminal 50A and the second terminal 50B. Moreover, the terminal 50 respectively includes the vertically elongated section 54 attached to the casing 11, the resilient connection part 59 extending in the insertion direction of the wire 150 from the vertically elongated section 54 and the contact part 571 located at the tip of the resilient connection part 59 that may come into contact with the conductive wire 151 of the wire 150 inserted between the first terminal 50A and the second terminal 50B. Consequently, despite its small and simplified structure, the connector 1 enables and ensures the detection of contact between the wire 150 and the terminal 50, making it highly reliable while realizing low cost manufacturing.

Furthermore, the terminal 50 is located closer to the front in the insertion direction of the wire 150 from the contact part 571 and respectively includes the front engaging part 58 that is locked and secured onto the casing 11. This allows the terminal 50 and the casing 11 to be joined without fail, ensuring that the position of the terminal 50 is determined with respect to the casing 11 while stably maintaining the orientation of the terminal 50. Therefore, even though the wire 150 is not in an inserted state, the first terminal 50A and the second terminal 50B assuredly remain in a state separated from each other.

Moreover, the first contact part 571A of the first terminal 50A and the second contact part 571B of the second terminal 50B are separated from each other in the initial state when the wire 150 has not yet been inserted. Further, the first contact part 571A of the first terminal 50A and the second contact part 571B of the second terminal 50B are separated in the direction perpendicularly crossing with respect to the insertion direction of the wire 150 by an interval W that is smaller than the diameter of the conductive wire 151 of the wire 150. Furthermore, the first terminal 50A and the second terminal 50B are in a linearly symmetrical form having the virtual straight line L extending in the insertion direction of the wire 150 as a symmetric axis and are arranged on both the right and left sides of the virtual straight line L. Therefore, while the wire 150 is not in an inserted state, the first terminal 50A and the second terminal 50B assuredly remain in a state of being separated from each other.

Furthermore, once the wire 150 is inserted, the first contact part 571A of the first terminal 50A and the second contact part 571B of the second terminal 50B come into contact by clamping the conductive wire 151 of the wire 150, thereby causing the first terminal 50A and the second terminal 50B to become mutually conductive to each other. Moreover, the first terminal 50A and the second terminal 50B respectively include the rear connection part 53 to be connected to the rear connection pattern 96 of the substrate 91, with the rear connection pattern 96 connected to a detection circuit which detects that conductivity has been established between the first terminal 50A and the second terminal 50B. From this, once the wire 150 is inserted, the first terminal 50A and the second terminal 50B on the right and left become conductive to each other via the conductive wire 151, enabling the detection circuit to assuredly detect that the wire 150 has been inserted into the connector 1 and the conductive wire 151 has come into contact with the terminal 50.

Next, a second embodiment will be described. Note that the description of objects having the same structures as those of the first embodiment will be omitted by being denoted by the same reference numerals. Furthermore, the description of operations and effects that are the same as those of the first embodiment will be omitted.

Figure 9:
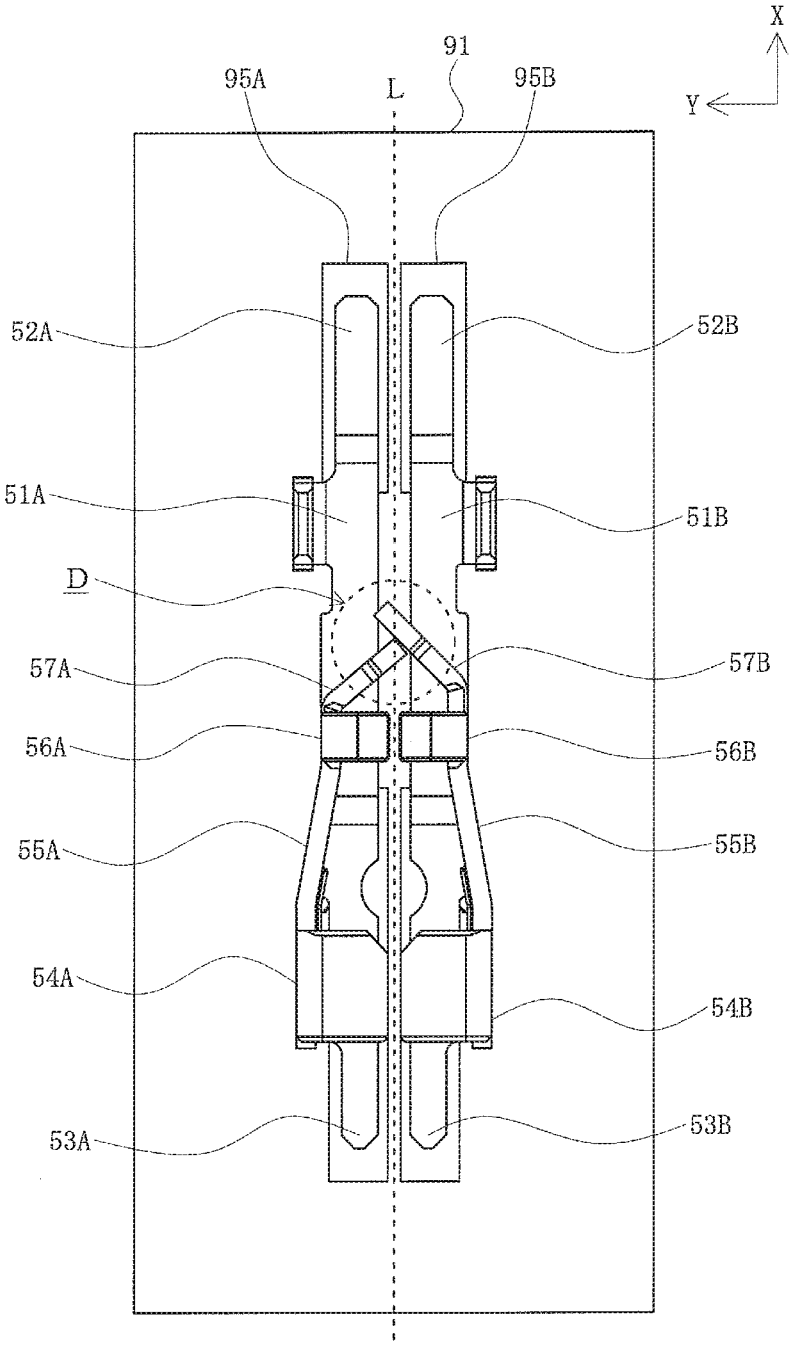
FIG. 9 is a top view of a terminal in accordance with a second embodiment.
Figure 10:
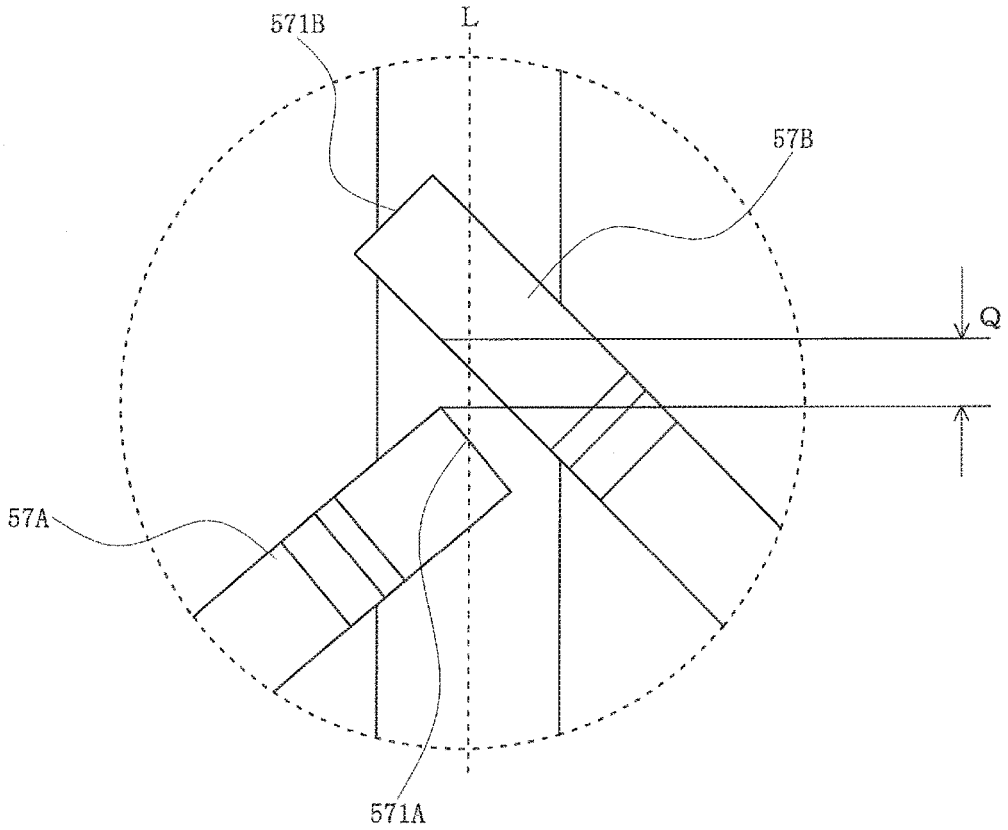
FIG. 10 is an enlarged view of part D of FIG. 9, showing an enlarged view of the main part of the terminal in accordance with the second embodiment.

FIG. 9 is a top view of a terminal in accordance with the second embodiment, while FIG. 10 is an enlarged view of part D of FIG. 9, showing an enlarged view of the main part of the terminal in accordance with the second embodiment.

In the present embodiment, although the first terminal 50A and the second terminal 50B are substantially in a linearly symmetric form having virtual straight line L as a symmetric axis, strictly speaking, they are not linearly symmetric, and part of the first resilient connection part 59A and the second resilient connection part 59B, specifically the first contacting piece 57A and the second contacting piece 57B, are not linearly symmetrical, but rather the first contact part 571A, which is the tip of the first contacting piece 57A, and the second contact part 571B, which is the tip of the second contacting piece 57B, are at different locations with regard to the insertion direction of the wire 150.

In an illustrated example, the first contact part 571A of the first contacting piece 57A on the left side is on the virtual straight line L or in a location on the right side sticking out from the virtual straight line L in a plane view. On the other hand, in a plane view, the second contact part 571B of the second contacting piece 57B on the right side is closer to the front than the first contact part 571A and is on the virtual straight line L or at a location on the left side sticking out from the virtual straight line L. Moreover, the first contacting piece 57A and the second contacting piece 57B are separated by an interval Q in the front and rear direction. Therefore, as in the first embodiment, the first terminal 50A and the second terminal 50B are separated from each other in the initial state in which the wire 150 has not yet been inserted therein.

It should be noted that descriptions of configurations and operations of other aspects of the connector 1 that are the same as the first embodiment will be omitted.

As described, in the present embodiment, contact parts 571 on the right and left are either on the virtual straight line L or in a location on the opposite side sticking out from the virtual straight line L. This increases the amount of displacement of contact parts 571 on the right and left that are pushed and spread open by the tip of the wire 150 when connecting the wire 150 by inserting into the connector 1. Consequently, the spring force invoked by the front elongated section 55 that has been resiliently deformed by the wire 150 and the contacting piece 57 increases, causing the contact parts 571 on the right and left to clamp the conductive wire 151 with a strong force while ensuring that the contact of the conductive wire 151 and the terminal 50 is maintained.

Next, a third embodiment will be described. It should be noted that the description of objects having the same structure as the first and second embodiments will be omitted by denoting said objects by the same symbols. Furthermore, descriptions of operations and effects that are the same as those of the first and second embodiments will also be omitted.

Figure 11:
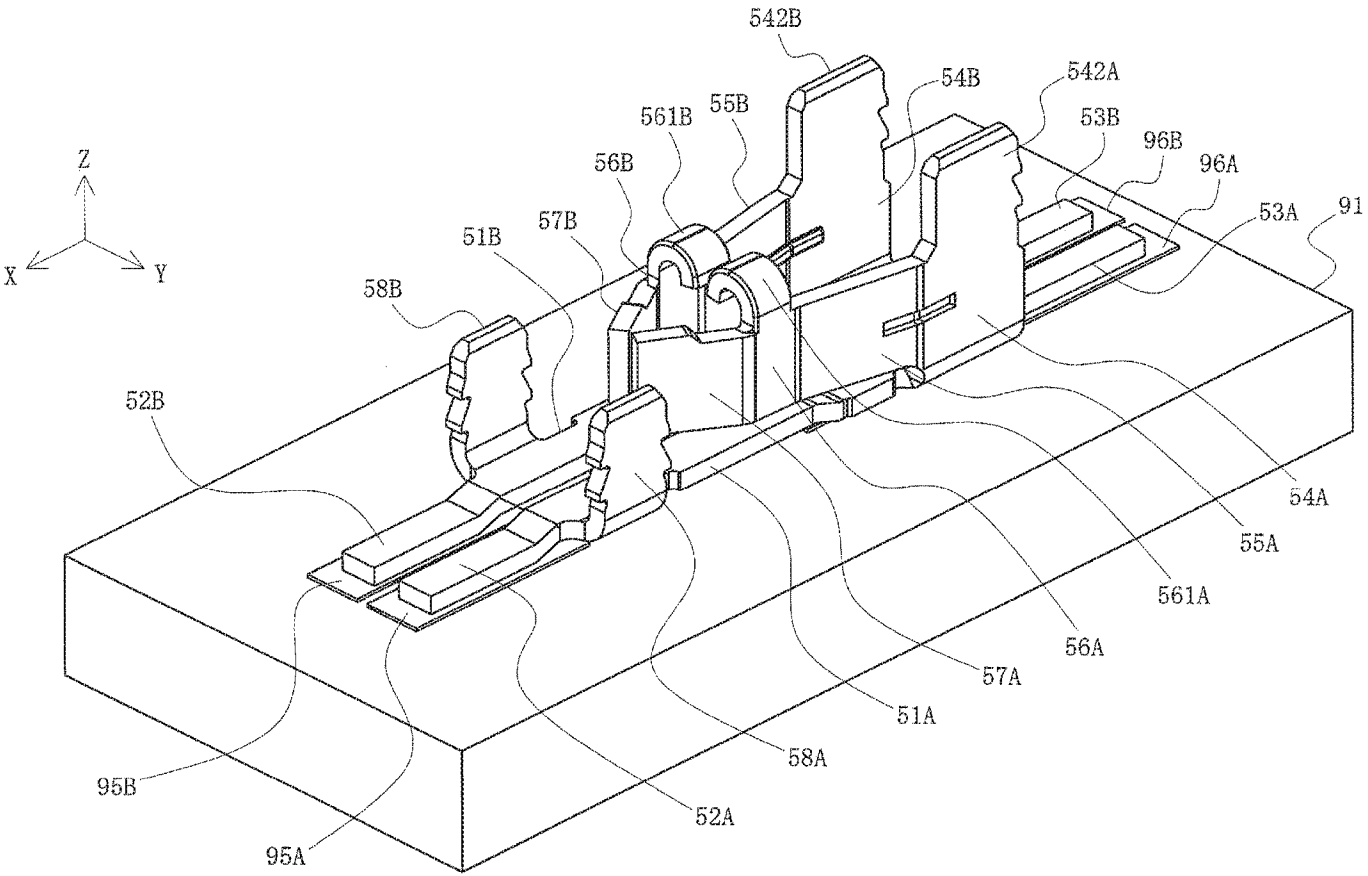
FIG. 11 is a perspective view of a terminal in accordance with a third embodiment.
Figure 12:
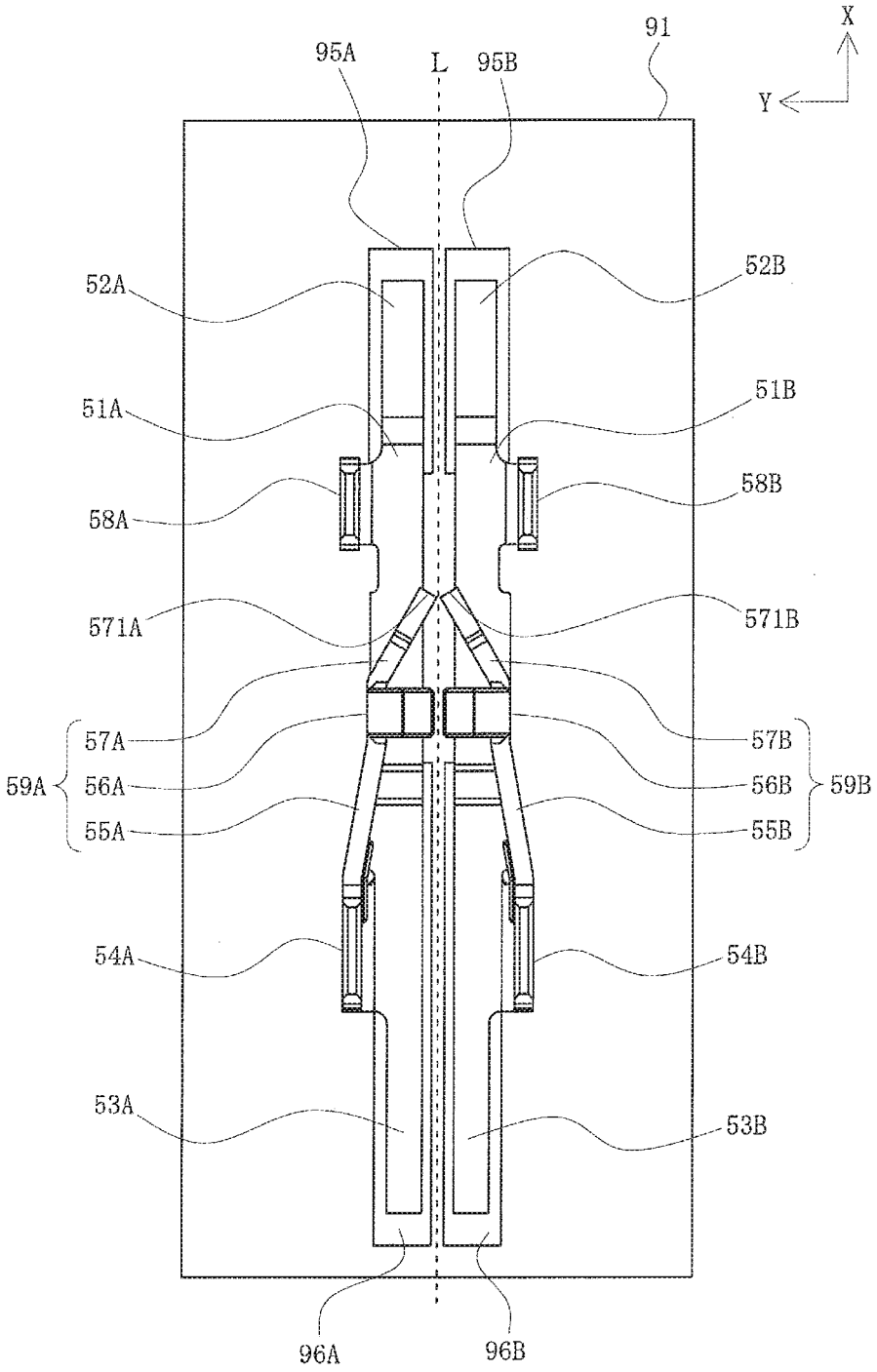
FIG. 12 is a top view of the terminal in accordance with the third embodiment.
Figure 13:
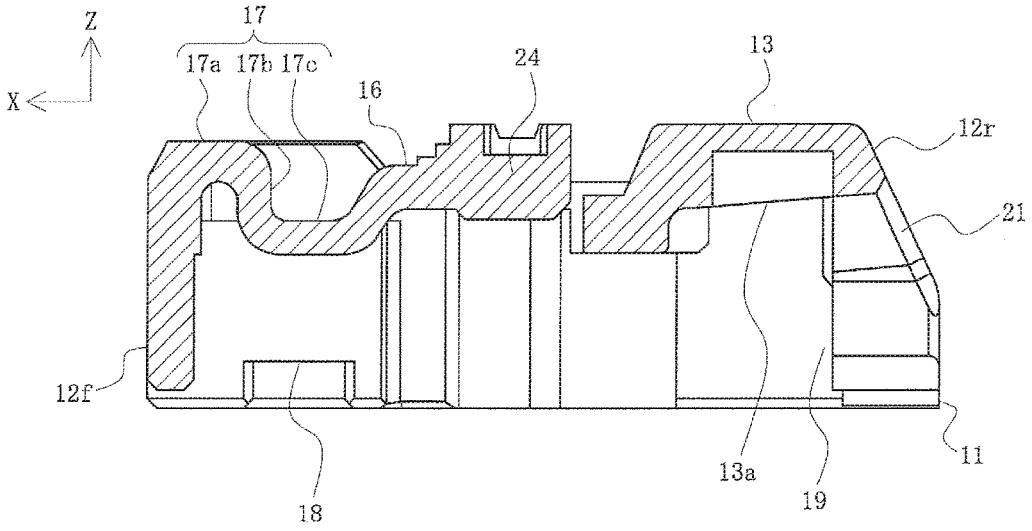
FIG. 13 is a longitudinal cross-sectional view of a housing in accordance with the third embodiment.
Figure 14:
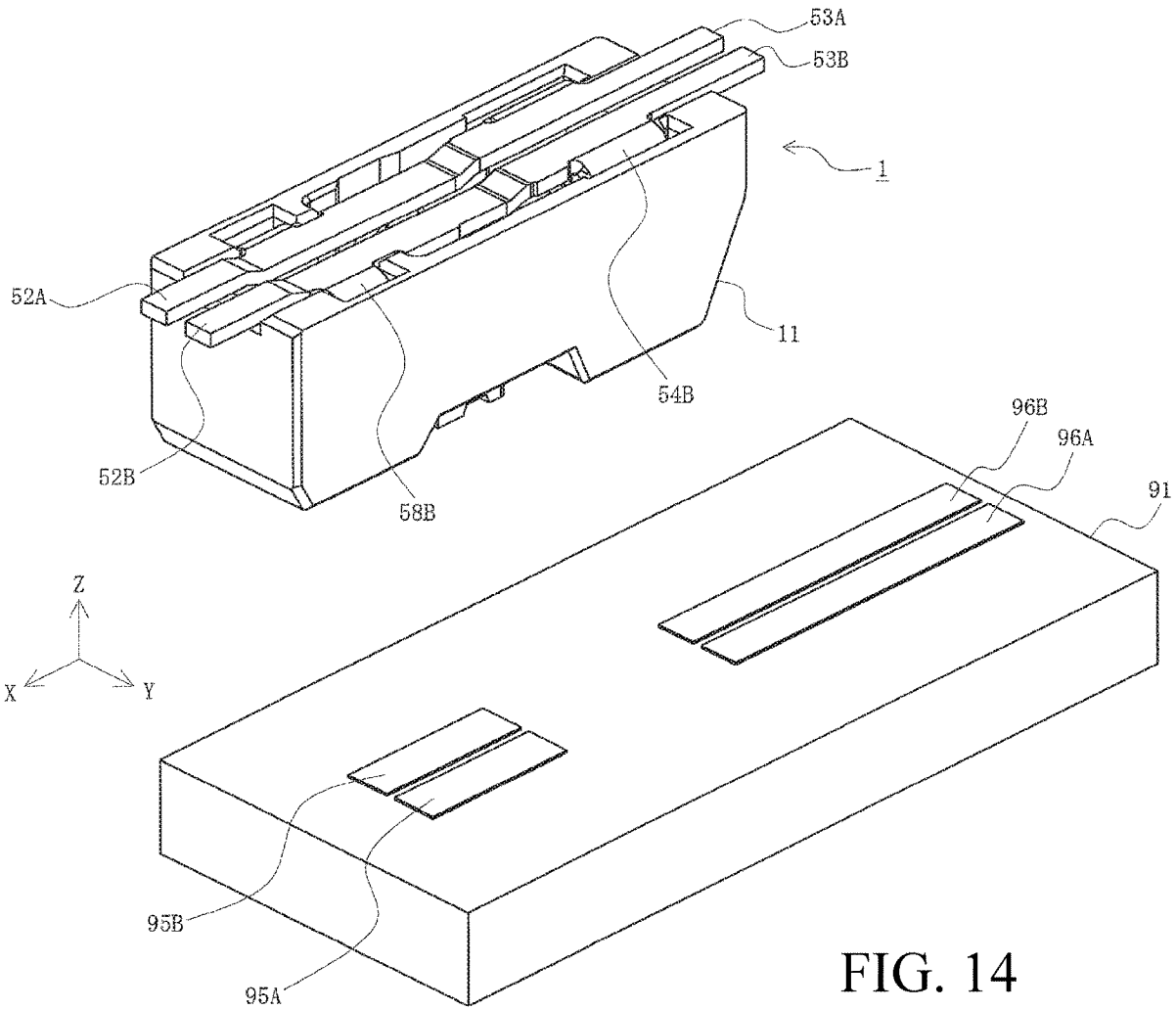
FIG. 14 is a perspective view illustrating the state before a connector according to the third embodiment is mounted on a substrate.
Figure 15:
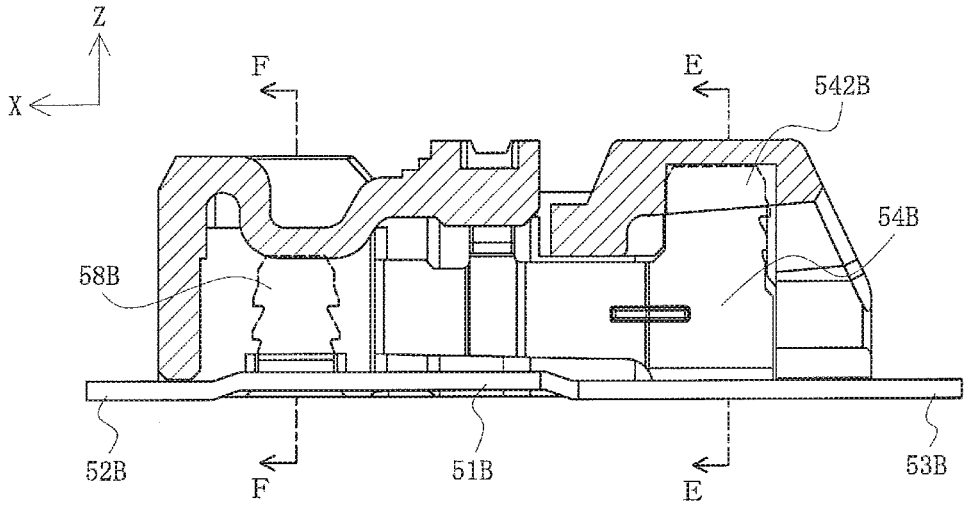
FIG. 15 is a longitudinal cross-sectional view of the connector in accordance with the third embodiment.
Figure 16:
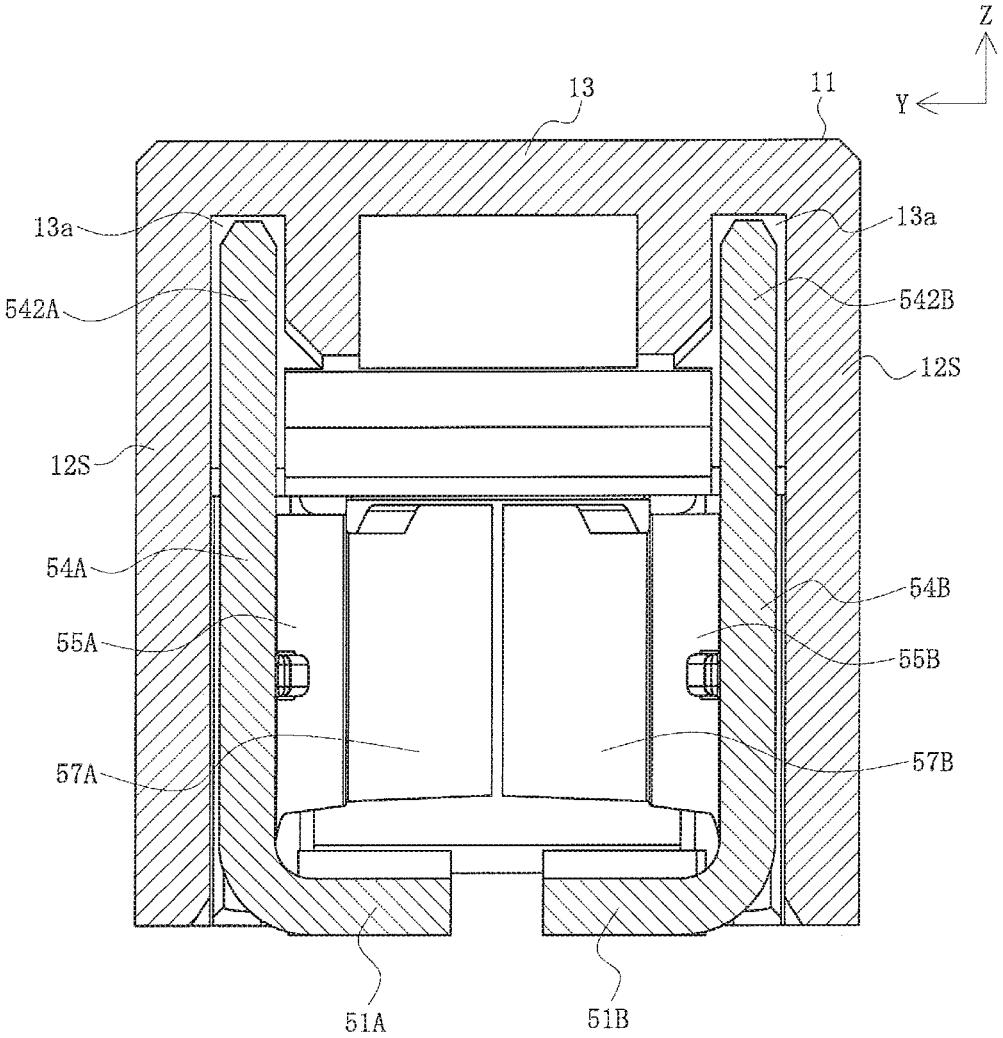
FIG. 16 is a cross-sectional view in the direction of arrow E-E in FIG. 15, and is a first transverse cross-sectional view of the connector in accordance with the third embodiment.
Figure 17:
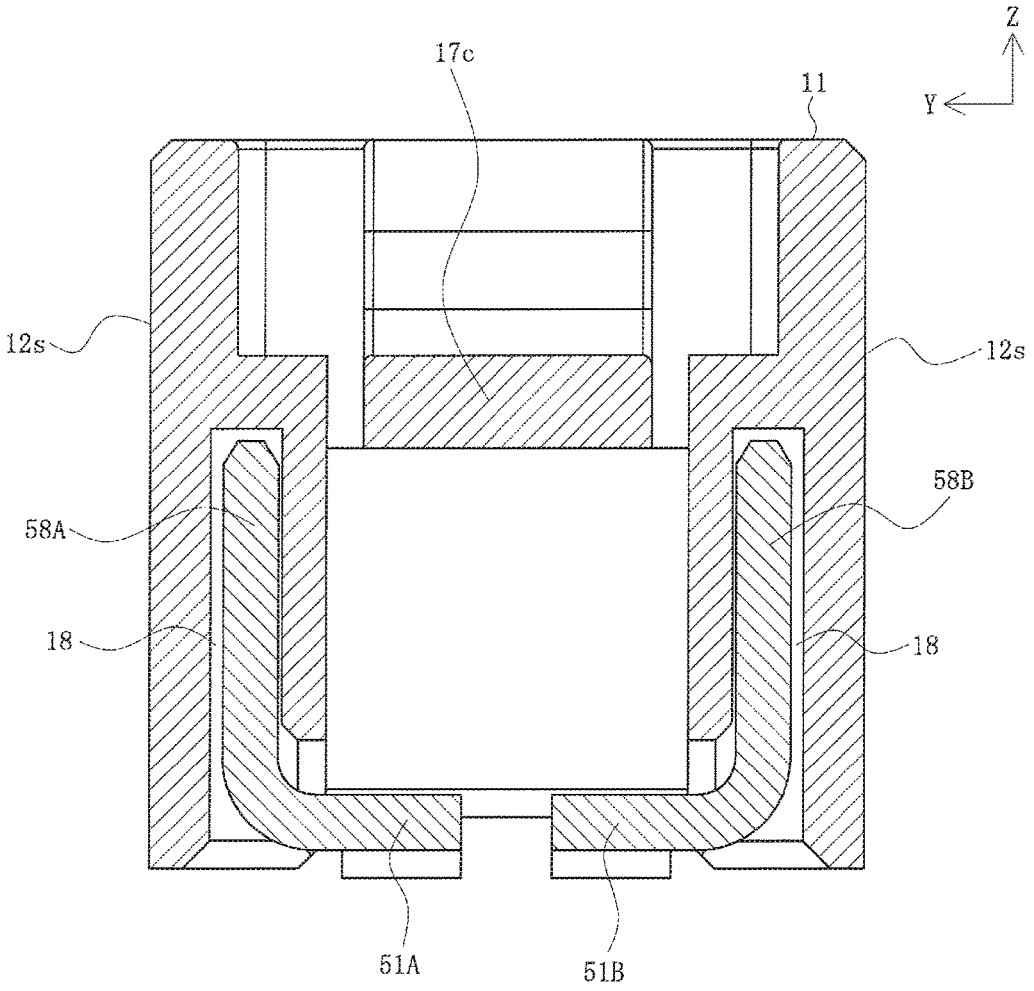
FIG. 17 is a cross-sectional view in the direction of arrow F-F in FIG. 15, and is a second transverse cross-sectional view of the connector in accordance with the third embodiment.
Figure 18:
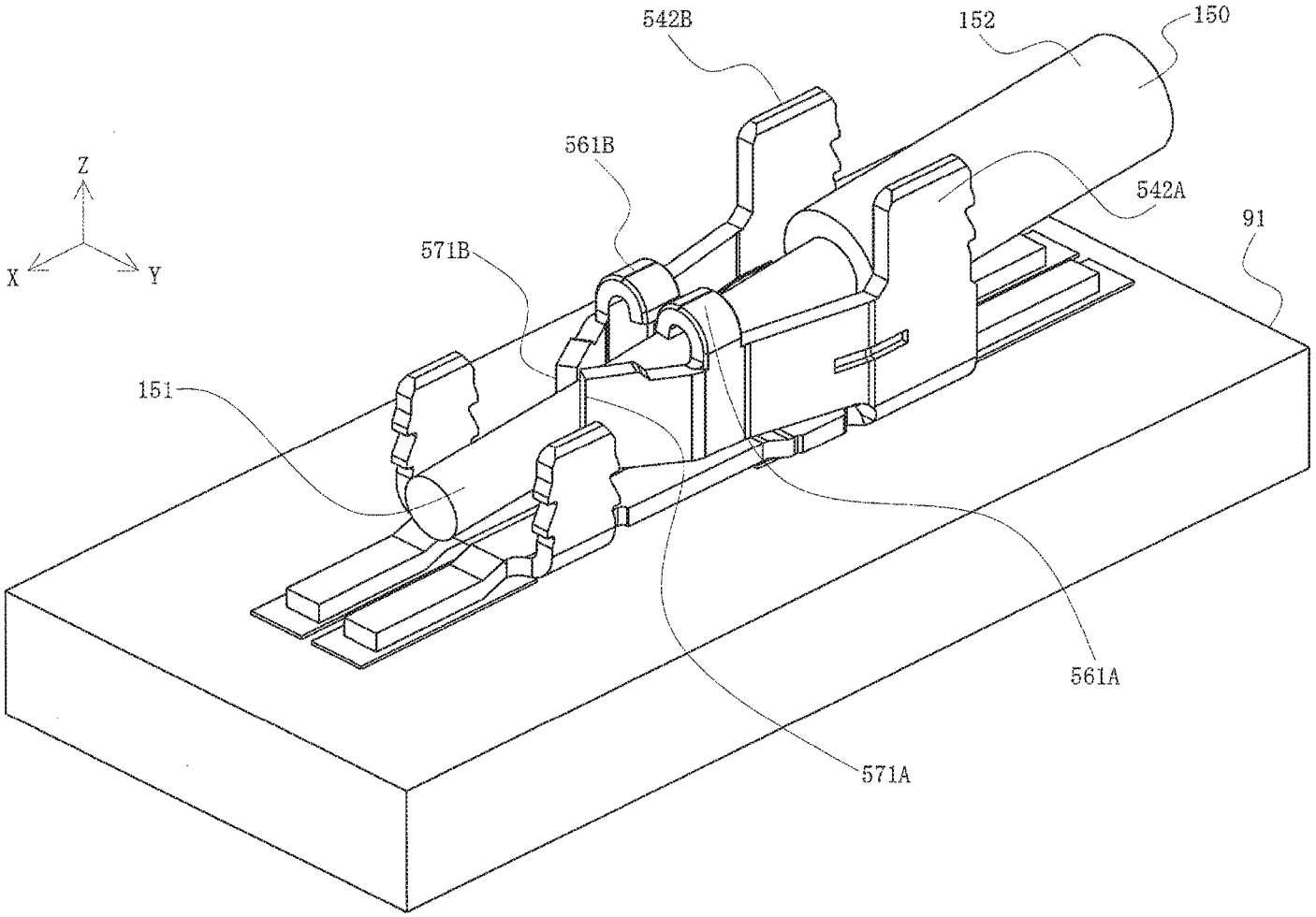
FIG. 18 is a perspective view of the terminal into which a wire has been inserted in accordance with the third embodiment.

FIG. 11 is a perspective view of a terminal in accordance with the third embodiment, FIG. 12 is a top view of the terminal in accordance with the third embodiment, FIG. 13 is a longitudinal cross-sectional view of a housing in accordance with the third embodiment, FIG. 14 is a perspective view illustrating the state before a connector in the third embodiment is mounted on a substrate, FIG. 15 is a longitudinal cross-sectional view of the connector in accordance with the third embodiment, FIG. 16 is a cross-sectional view in the direction of arrow E-E in FIG. 15, and is a first transverse cross-sectional view of the connector in accordance with the third embodiment, FIG. 17 is a cross-sectional view in the direction of arrow F-F in FIG. 15, and is a second transverse cross-sectional view of the connector in accordance with the third embodiment, and FIG. 18 is a perspective view of the terminal into which a wire has been inserted in accordance with the third embodiment.

The terminal 50 in the present embodiment does not have the horizontally elongated section 541 extending inward from the upper end of the vertically elongated section 54; however, a rear engaging part 542 is provided instead as a securing part extending further upward from the upper end of the vertically elongated section 54. Furthermore, as illustrated in FIG. 13, in the upper part of the terminal rear engaging part 19 in the side face part 12*s* of the casing 11, a terminal rear recessed part 13*a*, which is a hole part to lock the rear engaging part 542 after entering thereto, is formed.

Moreover, as illustrated in FIGS. 14 and 15, when the casing 11 covering substantially the entire circumference of the terminal 50 is in a mounted state, as illustrated in FIG. 17, the front engaging part 58 enters the terminal front recessed part 18 until it is locked and secured, while, as illustrated in FIG. 16, the rear engaging part 542 enters the terminal rear recessed part 13*a* until it is locked and secured, further ensuring the unification of the terminal 50 and the casing 11.

Furthermore, the front engaging part 58 and the rear engaging part 542 located in the front end proximity and rear end proximity of the base part 51 enter, until locked, into the terminal front recessed part 18 and the terminal rear recessed part 13*a* formed in the casing 11 as hole parts, ensuring that the position of the terminal 50 is determined with respect to the casing 11 while stably maintaining the orientation of the terminal 50. Thereby, the relative positional relationship of the first terminal 50A and the second terminal 50B arranged on both the right and left sides of the virtual straight line L may be stably maintained, with a small interval W between the first contact part 571A of the first contacting piece 57A and the second contact part 571B of the second contacting piece 57B also being stably maintained.

Particularly, because the rear engaging part 542 located at the upper end of the vertically elongated section 54 that is the base of the resilient connection part 59 is in a state of being retained by the casing 11, the position of the contact part 571 which is the tip of the resilient connection part 59 is stably maintained, ensuring that the small interval W between the right and left contact parts 571 is maintained.

Therefore, even if there is an error in the manufacturing process of the terminal 50 or in the process of connecting the terminal 50 to the front connection pattern 95 and the rear connection pattern 96 of the substrate 91, because the small interval W between the first contact part 571A and the second contact part 571B is assuredly maintained, when the wire 150 is in the initial state before being inserted, the mutually separated state of the first terminal 50A and the second terminal 50B is assuredly maintained, preventing the occurrence of erroneous detections by the detection circuit.

As illustrated in FIG. 14, in the event of mounting the connector 1 in the present embodiment on the surface of the substrate 91, while the terminal 50 and the casing 11 are in a joined state, that is, when the locations of the first terminal 50A and the second terminal 50B with respect to the casing 11 have been determined and the first terminal 50A and the second terminal 50B are in a state of being retained by the casing 11, the first front connection part 52A and the second front connection part 52B as well as the first rear connection part 53A and the second rear connection part 53B are placed on the first front connection pattern 95A and the second front connection pattern 95B as well as the first rear connection pattern 96A and the second rear connection pattern 96B on the substrate 91 so as to be connected preferably by a connecting means such as soldering, or the like. It should be noted that in FIG. 14, the orientation of the connector 1 is upside down for the convenience of explanation.

Thereby, the relative positional relationship of the first terminal 50A and the second terminal 50B arranged on both the right and left sides of the virtual straight line L may be stably maintained when the connector 1 is in a state of having been mounted on the surface of the substrate 91, with the small interval W between the first contact part 571A of the first contacting piece 57A and the second contact part 571B of the second contacting piece 57B also being stably maintained.

It should be noted that descriptions of configurations and operations of other aspects of the connector 1 that are the same as the first embodiment will be omitted.

As described, in the present embodiment, the vertically elongated section 54 respectively includes the rear engaging part 542 that is locked and secured by the casing 11. Therefore, the relative positional relationship of the first terminal 50A and the second terminal 50B may stably be maintained, while the small interval W between the first contact part 571A and the second contact part 571B is also stably maintained.

Next, a fourth embodiment will be described. It should be noted that descriptions of objects having the same structure as those of the first through third embodiments will be omitted by the objects thereof being denoted by the same symbols. Furthermore, likewise, descriptions will be omitted for operations and effects that are the same as those of the aforementioned first through third embodiments.

Figure 19:
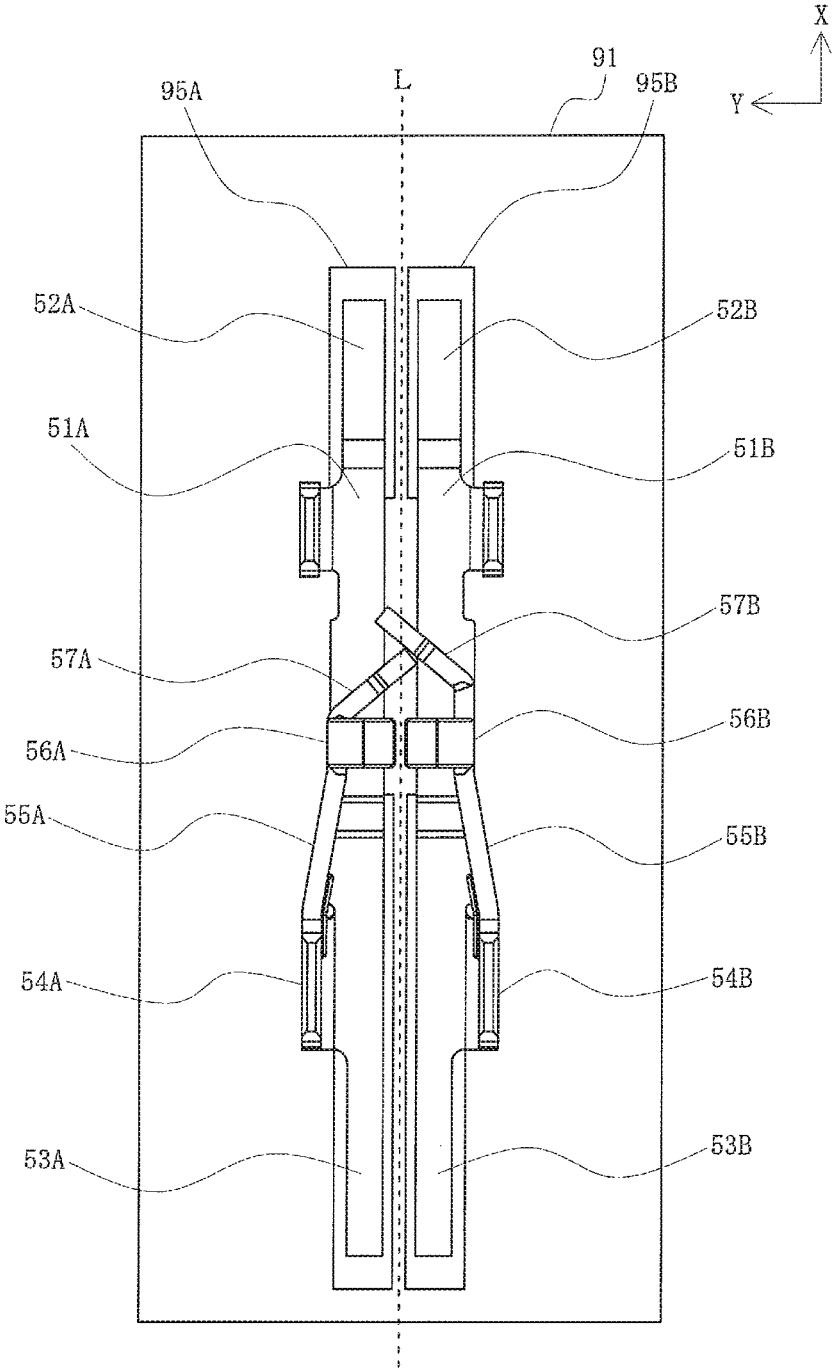
FIG. 19 is a top view of a terminal in accordance with a fourth embodiment.
Figure 20:
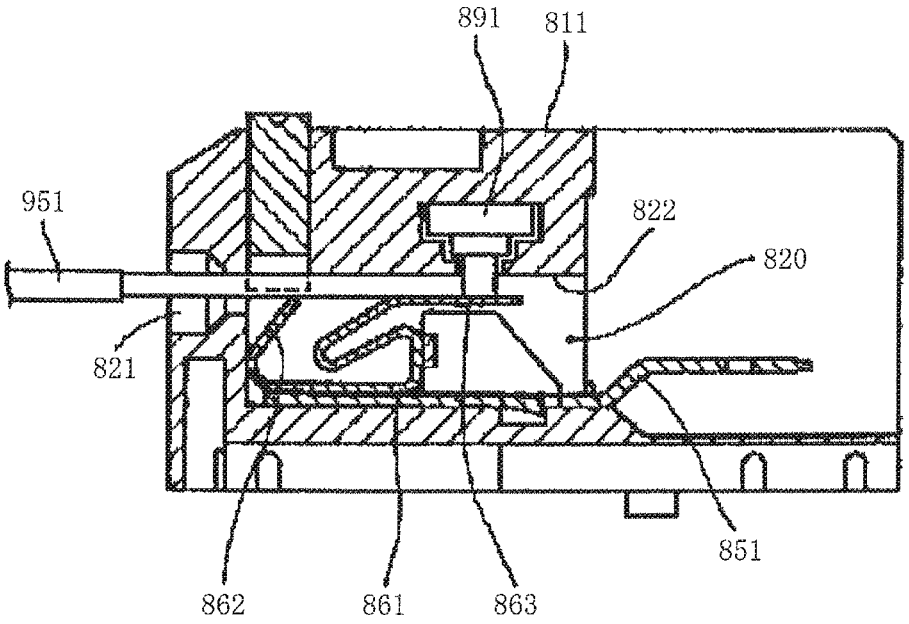
FIG. 20 Prior Art
FIG. 20 is a cross-section view of a conventional connector.

FIG. 19 is a top view of a terminal in accordance with the fourth embodiment.

In the present embodiment, although the first terminal 50A and the second terminal 50B are substantially in a linearly symmetric form having the virtual straight line L as a symmetric axis, strictly speaking, they are not linearly symmetric, and part of the first resilient connection part 59A and the second resilient connection part 59B, specifically, the first contacting piece 57A and the second contacting piece 57B, are not linearly symmetrical, but rather the positions of the front and rear direction of the first contact part 571A, which is the tip of the first contacting piece 57A, and the second contact part 571B, which is the tip of the second contacting piece 57B, are mutually offset.

In an example illustrated in the drawing, the first contact part 571A of the first contacting piece 57A on the left side is located on the virtual straight line L or is protruding on the right side from the virtual straight line L in a plane view. On the other hand, the second contact part 571B of the second contacting piece 57B on the right side is closer to the front from the first contact part 571A and is located on the virtual straight line L or is protruding on the left side from the virtual straight line L in a plane view. Moreover, the first contacting piece 57A and the second contacting piece 57B are separated in the front and rear direction. Therefore, as in the aforementioned embodiment 2, the first terminal 50A and the second terminal 50B are separated from each other in the initial state prior to the insertion of the wire 150.

It should be noted that descriptions of configurations and operations of other aspects of the connector 1 that are the same as those of the third embodiment will be omitted.

As described, in the present embodiment, contact parts 571 on the right and left are either on the virtual straight line L or are protruding onto the opposite side from the virtual straight line L. This increases the amount of displacement of contact parts 571 on the right and left that are pushed and spread open by the tip of the wire 150 when connecting the wire 150 by inserting into the connector 1. Consequently, the spring force invoked by the front elongated section 55 that has been resiliently deformed by the wire 150 and the contacting piece 57 increases, causing the contact parts 571 on the right and left to clamp the conductive wire 151 with a strong force while assuredly maintaining the contact of the conductive wire 151 and the terminal 50.

Note that the disclosure of the present specification describes characteristics related to preferred and exemplary embodiments. Various other embodiments, modifications and variations within the scope and spirit of the claims appended hereto could naturally be conceived by persons skilled in the art by summarizing the disclosures of the present specification.

The present disclosure may be applied to quick connect terminal connectors.

What is claimed is:

1. A quick connect terminal connector configured to connect a wire thereto, the quick connect terminal connector comprising:

a first terminal and a second terminal electrically separated from each other; and a casing that covers at least part of the first and second terminals, wherein the first and second terminals each comprise a base part, an attachment part, a resilient connection part and a contact part, each base part extends in an insertion direction of the wire, each attachment part extends from the respective base part in a direction orthogonal to the insertion direction of the wire, each attachment part is attached to the casing, each resilient connection part extends in the insertion direction of the wire from the respective attachment part, and each contact part is located at a tip of the respective resilient connection part, each contact part being configured to contact a conductive wire of the wire when the wire is inserted between the first and second terminals.

2. The quick connect terminal connector according to claim 1, wherein the contact part of the first terminal and the contact part of the second terminal are configured to clamp the conductive wire of the wire from opposite sides when the wire is inserted, thereby causing the first and second terminals to become mutually conductive to each other.

3. The quick connect terminal connector according to claim 1, wherein the first and second terminals each include a connection part that is configured to be connected to a connection pattern of a substrate, and wherein the connection pattern is configured to be connected to a detection circuit that detects an establishment of conductivity between the first and second terminals.

4. The quick connect terminal connector according to claim 1, wherein the base part of each terminal is not attached or locked to the casing.

5. The quick connect terminal connector according to claim 1, wherein each terminal includes a securing part that is locked onto the casing, each securing part extends upwardly from the respective base part.

6. The quick connect terminal connector according to claim 5, wherein each securing part is a front securing part, each front securing part being positioned forward of the respective contact part in the insertion direction of the wire.

7. The quick connect terminal connector according to claim 1, wherein, in an initial state prior to the insertion of the wire, the contact part of the first terminal and the contact part of the second terminal are separated from each other.

8. The quick connect terminal connector according to claim 7, wherein the contact part of the first terminal and the contact part of the second terminal are separated from each other by an interval smaller than a diameter of the conductive wire of the wire in a direction orthogonal to the insertion direction of the wire.

9. The quick connect terminal connector according to claim 7, wherein the contact part of the first terminal is positioned forward of the contact part of the second terminal in the insertion direction of the wire.

10. The quick connect terminal connector according to claim 7, wherein the first and second terminals are in a linearly symmetrical form having a virtual straight line as a symmetric axis extending in the insertion direction of the wire, wherein the first terminal is arranged on a first side of the virtual straight line, and wherein the second terminal is arranged on a second side of the virtual straight line.

11. The quick connect terminal connector according to claim 1, wherein each resilient connection part has a front connection part and a rear connection part, the front connection part extending forward from a front end of the respective base part, the rear connection part extending rearward from a rear end of the respective base part.

12. The quick connect terminal connector according to claim 11, wherein the front and rear connection parts of each terminal are positioned below the base part of each terminal.

13. A quick connect terminal connector configured to connect a wire thereto, wherein the wire has a conductive wire having a defined diameter, the quick connect terminal connector comprising:

a first terminal having a first base part and a first resilient connection part, the first resilient connection part having a first contact part, the first resilient connection part extending over the first base part in an insertion direction of the wire;

a second terminal having a second base part and a second resilient connection part, the second resilient connection part having a second contact part, the second resilient connection part extending over the second base part in the insertion direction of the wire; and a casing, the casing configured to cover at least a portion of each of the first and second terminals, the casing being attached to each of the first and second terminals, wherein each of the first and second contact parts is configured to contact the conductive wire of the wire when the wire is inserted between the first and second terminals, and wherein, in an initial state prior to the insertion of the wire, the first and second contact parts are separated from each other by an interval smaller than the defined diameter of the conductive wire.

14. The quick connect terminal connector according to claim 13, wherein the first contact part is positioned forward of the second contact part in the insertion direction of the wire.

15. The quick connect terminal connector according to claim 13, wherein the first and second terminals are in a linearly symmetrical form having a virtual straight line as a symmetric axis extending in the insertion direction of the wire, wherein the first terminal is arranged on a first side of the virtual straight line, and wherein the second terminal is arranged on a second side of the virtual straight line.

16. The quick connect terminal connector according to claim 13, wherein the first contact part and the second contact part are configured to clamp the conductive wire of the wire from opposite sides when the wire is inserted between the first and second terminals, thereby causing the first and second terminals to become mutually conductive to each other.

17. The quick connect terminal connector according to claim 13, wherein the first and second base parts are not attached or locked to the casing.

18. The quick connect terminal connector according to claim 13, wherein the first terminal further has a first front connection part and a first rear connection part, the first front connection part extending forward from a front end of the first base part, the first rear connection part extending rearward from a rear end of the first base part, the first front and rear connection parts being configured to be connected to a first connection pattern of a substrate, and wherein the second terminal further has a second front connection part and a second rear connection part, the second front connection part extending forward from a front end of the second base part, the second rear connection part extending rearward from a rear end of the second base part, the second front and rear connection parts being configured to be connected to a second connection pattern of the substrate.

19. The quick connect terminal connector according to claim 18, wherein the first front and rear connection parts of the first terminal are positioned below the first base part of the first terminal, and wherein the second front and rear connection parts of the second terminal are positioned below the second base part of the second terminal.

20. A quick connect terminal connector configured to connect a wire thereto, wherein the wire has a conductive wire, the quick connect terminal connector comprising:

a first terminal having a first base part and a first resilient connection part, the first resilient connection part having a first contact part, the first resilient connection part extending over the first base part in an insertion direction of the wire;

a second terminal having a second base part and a second resilient connection part, the second resilient connection part having a second contact part, the second resilient connection part extending over the second base part in the insertion direction of the wire; and a casing, the casing configured to cover at least a portion of each of the first and second terminals, the casing being attached to each of the first and second terminals, wherein the first and second terminals are in a linearly symmetrical form having a virtual straight line as a symmetric axis extending in the insertion direction of the wire, wherein the first terminal is arranged on a first side of the virtual straight line, and wherein the second terminal is arranged on a second side of the virtual straight line.

21. The quick connect terminal connector according to claim 20, wherein the first contact part is positioned forward of the second contact part in the insertion direction of the wire.

22. The quick connect terminal connector according to claim 20, wherein the first contact part and the second contact part are configured to clamp the conductive wire of the wire from opposite sides when the wire is inserted between the first and second terminals, thereby causing the first and second terminals to become mutually conductive to each other.

23. The quick connect terminal connector according to claim 20, wherein the first and second base parts are not attached or locked to the casing.

24. The quick connect terminal connector according to claim 20, wherein the first terminal further has a first front connection part and a first rear connection part, the first front connection part extending forward from a front end of the first base part, the first rear connection part extending rearward from a rear end of the first base part, the first front and rear connection parts being configured to be connected to a first connection pattern of a substrate, and wherein the second terminal further has a second front connection part and a second rear connection part, the second front connection part extending forward from a front end of the second base part, the second rear connection part extending rearward from a rear end of the second base part, the second front and rear connection parts being configured to be connected to a second connection pattern of the substrate.

25. The quick connect terminal connector according to claim 24, wherein the first front and rear connection parts of the first terminal are positioned below the first base part of the first terminal, and wherein the second front and rear connection parts of the second terminal are positioned below the second base part of the second terminal.

26. A quick connect terminal connector configured to connect a wire thereto, wherein the wire has a conductive wire, the quick connect terminal connector comprising:

a first terminal having a first base part and a first resilient connection part, the first resilient connection part having a first contact part, the first resilient connection part extending over the first base part in an insertion direction of the wire;

a second terminal having a second base part and a second resilient connection part, the second resilient connection part having a second contact part, the second resilient connection part extending over the second base part in the insertion direction of the wire; and a casing, the casing configured to cover at least a portion of each of the first and second terminals, the casing being attached to each of the first and second terminals, wherein the first contact part and the second contact part are configured to clamp the conductive wire of the wire from opposite sides when the wire is inserted between the first and second terminals, thereby causing the first and second terminals to become mutually conductive to each other.

27. The quick connect terminal connector according to claim 26, wherein the first contact part is positioned forward of the second contact part in the insertion direction of the wire.

28. The quick connect terminal connector according to claim 26, wherein the first and second base parts are not attached or locked to the casing.

29. The quick connect terminal connector according to claim 26, wherein the first terminal further has a first front connection part and a first rear connection part, the first front connection part extending forward from a front end of the first base part, the first rear connection part extending rearward from a rear end of the first base part, the first front and rear connection parts being configured to be connected to a first connection pattern of a substrate, and wherein the second terminal further has a second front connection part and a second rear connection part, the second front connection part extending forward from a front end of the second base part, the second rear connection part extending rearward from a rear end of the second base part, the second front and rear connection parts being configured to be connected to a second connection pattern of the substrate.

30. The quick connect terminal connector according to claim 29, wherein the first front and rear connection parts of the first terminal are positioned below the first base part of the first terminal, and wherein the second front and rear connection parts of the second terminal are positioned below the second base part of the second terminal.

31. A quick connect terminal connector configured to connect a wire thereto, the quick connect terminal connector comprising:

a first terminal and a second terminal electrically separated from each other; and a casing that covers at least part of the first and second terminals, wherein the first and second terminals each comprise an attachment part, a front securing part, a resilient connection part and a contact part, each attachment part is attached to the casing, each front securing part is locked onto the casing, each resilient connection part extends in an insertion direction of the wire from the respective attachment part, and each contact part is located at a tip of the respective resilient connection part, each contact part being configured to contact a conductive wire of the wire when the wire is inserted between the first and second terminals, each front securing part being positioned forward of the respective contact part in the insertion direction of the wire.

32. The quick connect terminal connector according to claim 31, wherein the contact part of the first terminal and the contact part of the second terminal are configured to clamp the conductive wire of the wire from opposite sides when the wire is inserted, thereby causing the first and second terminals to become mutually conductive to each other.

33. The quick connect terminal connector according to claim 31, wherein the first and second terminals each include a connection part that is configured to be connected to a connection pattern of a substrate, and wherein the connection pattern is configured to be connected to a detection circuit that detects an establishment of conductivity between the first and second terminals.

34. A quick connect terminal connector configured to connect a wire thereto, the quick connect terminal connector comprising:

a first terminal and a second terminal electrically separated from each other; and a casing that covers at least part of the first and second terminals, wherein the first and second terminals each comprise an attachment part, a resilient connection part and a contact part, each attachment part is attached to the casing, each resilient connection part extends in an insertion direction of the wire from the respective attachment part, and each contact part is located at a tip of the respective resilient connection part, each contact part being configured to contact a conductive wire of the wire when the wire is inserted between the first and second terminals, wherein, in an initial state prior to the insertion of the wire, the contact part of the first terminal and the contact part of the second terminal are separated from each other, and wherein the contact part of the first terminal is positioned forward of the contact part of the second terminal in the insertion direction of the wire.

35. The quick connect terminal connector according to claim 34, wherein the contact part of the first terminal and the contact part of the second terminal are separated from each other by an interval smaller than a diameter of the conductive wire of the wire in a direction orthogonal to the insertion direction of the wire.

36. The quick connect terminal connector according to claim 34, wherein the first and second terminals are in a linearly symmetrical form having a virtual straight line as a symmetric axis extending in the insertion direction of the wire, wherein the first terminal is arranged on a first side of the virtual straight line, and wherein the second terminal is arranged on a second side of the virtual straight line.

37. The quick connect terminal connector according to claim 34, wherein the contact part of the first terminal and the contact part of the second terminal are configured to clamp the conductive wire of the wire from opposite sides when the wire is inserted, thereby causing the first and second terminals to become mutually conductive to each other.

38. The quick connect terminal connector according to claim 34, wherein the first and second terminals each include a connection part that is configured to be connected to a connection pattern of a substrate, and wherein the connection pattern is configured to be connected to a detection circuit that detects an establishment of conductivity between the first and second terminals.

39. A quick connect terminal connector configured to connect a wire thereto, wherein the wire has a conductive wire having a defined diameter, the quick connect terminal connector comprising:

a first terminal having a first resilient connection part, the first resilient connection part having a first contact part;

a second terminal having a second resilient connection part, the second resilient connection part having a second contact part; and a casing, the casing configured to cover at least a portion of each of the first and second terminals, the casing being attached to each of the first and second terminals, wherein each of the first and second contact parts is configured to contact the conductive wire of the wire when the wire is inserted between the first and second terminals, and wherein, in an initial state prior to the insertion of the wire, the first and second contact parts are separated from each other by an interval smaller than the defined diameter of the conductive wire, and wherein the first contact part is positioned forward of the second contact part in the insertion direction of the wire.

40. The quick connect terminal connector according to claim 39, wherein the first and second terminals are in a linearly symmetrical form having a virtual straight line as a symmetric axis extending in the insertion direction of the wire, wherein the first terminal is arranged on a first side of the virtual straight line, and wherein the second terminal is arranged on a second side of the virtual straight line.

41. The quick connect terminal connector according to claim 39, wherein the first contact part and the second contact part are configured to clamp the conductive wire of the wire from opposite sides when the wire is inserted between the first and second terminals, thereby causing the first and second terminals to become mutually conductive to each other.

42. A quick connect terminal connector configured to connect a wire thereto, wherein the wire has a conductive wire, the quick connect terminal connector comprising:

a first terminal having a first resilient connection part, the first resilient connection part having a first contact part;

a second terminal having a second resilient connection part, the second resilient connection part having a second contact part; and a casing, the casing configured to cover at least a portion of each of the first and second terminals, the casing being attached to each of the first and second terminals, wherein the first and second terminals are in a linearly symmetrical form having a virtual straight line as a symmetric axis extending in the insertion direction of the wire, wherein the first terminal is arranged on a first side of the virtual straight line, and wherein the second terminal is arranged on a second side of the virtual straight line, and wherein the first contact part is positioned forward of the second contact part in the insertion direction of the wire.

43. The quick connect terminal connector according to claim 42, wherein the first contact part and the second contact part are configured to clamp the conductive wire of the wire from opposite sides when the wire is inserted between the first and second terminals, thereby causing the first and second terminals to become mutually conductive to each other.

44. A quick connect terminal connector configured to connect a wire thereto, wherein the wire has a conductive wire, the quick connect terminal connector comprising:

a first terminal having a first resilient connection part, the first resilient connection part having a first contact part;

a second terminal having a second resilient connection part, the second resilient connection part having a second contact part; and a casing, the casing configured to cover at least a portion of each of the first and second terminals, the casing being attached to each of the first and second terminals, wherein the first contact part and the second contact part are configured to clamp the conductive wire of the wire from opposite sides when the wire is inserted between the first and second terminals, thereby causing the first and second terminals to become mutually conductive to each other, and wherein the first contact part is positioned forward of the second contact part in the insertion direction of the wire.

* * * * *